US008500137B2

(12) United States Patent
Ardestany

(10) Patent No.: US 8,500,137 B2
(45) Date of Patent: Aug. 6, 2013

(54) COUPLER DEVICE FOR IN-LINE SKATE FOR ALL-TERRAIN SURFACES

(76) Inventor: Barry Bahram Ardestany, Chandler, AZ (US)

( * ) Notice: Subject to any disclaimer, the term of this patent is extended or adjusted under 35 U.S.C. 154(b) by 0 days.

(21) Appl. No.: 13/526,818

(22) Filed: Jun. 19, 2012

(65) Prior Publication Data

US 2013/0001903 A1 Jan. 3, 2013

Related U.S. Application Data

(60) Provisional application No. 61/571,506, filed on Jun. 29, 11.

(51) Int. Cl.
*A63C 17/02* (2006.01)

(52) U.S. Cl.
USPC ..... 280/11.221; 280/11.222; 280/11.223; 280/11.226

(58) Field of Classification Search
USPC ..... 280/11.19, 11.2, 11.22, 11.23, 11.25, 280/11.27, 11.28, 811, 842
See application file for complete search history.

(56) References Cited

U.S. PATENT DOCUMENTS 5,257,793 A * 11/1993 Fortin ..... 280/7.13
6,045,142 A * 4/2000 Andrich ..... 280/11.221

* cited by examiner

*Primary Examiner* — John Walters
*Assistant Examiner* — James Triggs
(74) *Attorney, Agent, or Firm* — Richard E. Oney; Tiffany & Bosco, P.A.

(57) ABSTRACT

An exemplary embodiment of the present invention includes a first coupler device configured to couple to the frame of an in-line skate. The first coupler device includes a linear portion and an angled portion where the linear portion and the angled portion have different lengths. The linear portion includes a first hole configured to couple to the frame of the in-line skate and the first hole is located near the end of the linear portion that is opposite the angled portion. The linear portion includes a second hole located at an area where the linear portion meets the angled portion. The angled portion has an angle greater than zero and includes a third hole near the end of the angled portion that is opposite the linear portion.

20 Claims, 19 Drawing Sheets

COUPLER DEVICE FOR IN-LINE SKATE FOR ALL-TERRAIN SURFACES

RELATED APPLICATIONS

This application claims priority from and the benefit of U.S. Provisional Patent Application Ser. No. 61/571,506, filed Jun. 29, 2011 (titled "Cool blade 4×4"), the entire contents of which are hereby incorporated by reference.

FIELD OF INVENTION

This invention relates to one or more devices, systems, and methods of an in-line skate configured to move on multiple types of terrain and surfaces. Specific examples of embodiments of this invention relate to a first coupler device and/or a second coupler device for coupling one or more wheels on at least one of the front end and the back end of the in-line skate. The first coupler device and second coupler device allow the in-line skate to be capable of moving over diverse types of terrain and surfaces.

BACKGROUND OF THE INVENTION

An in-line skate is a type of roller skate. A typical roller skate (or quad skate) has two horizontal wheels in front and two horizontal wheels in back of the bottom of a boot with a front stopper and/or a back stopper. A typical in-line skate has two, three, four, or five wheels configured in a single-file line (or linear line) on the bottom of the boot with (or without) a front stopper and/or a back stopper. Each of the wheels of a typical in-line skate are the same size (e.g., from about 30 millimeters to about 70 millimeters in diameter). A popular brand of in-line skates is Rollerblade®.

In-line skates are designed to move on smooth surfaces. For example, an in-line skate is designed to move, roll, or otherwise travel over an arena floor, a cement sidewalk, a paved road, a smooth bike path, or other smooth and even surface. However, moving, rolling, or otherwise traveling on an uneven surface (e.g., grass, gravel, dirt, rocks, mud, snow, ice, or other) using an in-line skate is nearly impossible. On these uneven surfaces, the wheels of the in-line skate are not able to freely rotate, so the user of the in-line skate will slow-down, stop, fall, topple over, or otherwise lose control.

The present invention of an in-line skate adds one or more coupler devices and third, fourth, fifth (or more) wheels. The coupler devices and third, fourth, fifth (or more) wheels of the present invention vary in size and shape to provide stability to the in-line skate. The present invention configures the in-line skate, so that it is able to move, roll, or otherwise travel over smooth and uneven surfaces without causing the user of the in-line skate to slow-down, stop, fall, topple over, or otherwise lose control while using the in-line skate. The addition of the coupler devices and additional wheels to an in-line skate, particularly at the front end and/or back end of the in-line skate provides stability and easy rotation of the wheels over various surfaces. The present invention gives the user of the in-line skate more support to his/her ankles because the center of gravity of the user using the first coupler and/or second coupler of the present invention is lower compared to a typical in-line skate. The present invention allows the weight of the user to be split between the extra wheels at the front end and/or back end of the in-line skate (which makes the center of gravity of the user lower than the front end and/or back end of the in-line skate).

SUMMARY OF THE INVENTION

Exemplary embodiments of the present invention are described (but not limited to) include:

A device for coupling to an in-line skate device (where the in-line skate device includes a boot configured to couple to a frame, the frame is configured to couple to at least a first wheel and a second wheel and the frame is linear in shape and traverses at least a portion of the bottom of the boot), including a first coupler device configured to couple to the frame, the first coupler device includes a linear portion and an angled portion wherein the linear portion and the angled portion have different lengths. The linear portion includes a first hole configured to couple to the frame and the first hole is located near the end of the linear portion that is opposite the angled portion. The linear portion includes a second hole located at an area where the linear portion meets the angled portion, the angled portion has an angle greater than zero, and the angled portion includes a third hole near the end of the angled portion that is opposite the linear portion.

The device can include wherein the second hole is configured to couple to the frame and the third hole of the angled portion is configured to couple to a third wheel of the in-line skate device.

The device can include wherein the linear portion of the first coupler device varies in length from 1 inch to 25 inches, the angled portion of the first coupler device varies in length from 1 inch to 25 inches, and the angled portion of the first coupler device varies in range from 1 degree to 90 degrees.

The device can include wherein at least one of the first coupler device is coupled to a front portion of the frame and a second coupler device is coupled to the front portion of the frame such that the first and second coupler devices sandwich the frame at the front portion; and a third coupler device is coupled to a back portion of the frame and a fourth coupler device is coupled to the back portion of the frame such that the third and fourth coupler devices sandwich the frame at the back portion.

The device can include wherein at least one of the linear portion of the first coupler device is coupled to the frame on the front portion of the frame and the angled portion of the first coupler device is coupled to a third wheel on the front portion of the frame; and the linear portion of the second coupler device is coupled to the frame on the front portion of the frame and the angled portion of the second coupler device is coupled to the third wheel on the front portion of the frame.

The device can include wherein at least one of the linear portion of the third coupler device is coupled to the frame on the back portion of the frame and the angled portion of the third coupler device is coupled to a fourth wheel on the back portion of the frame; and the linear portion of the fourth coupler device is coupled to the frame on the back portion of the frame and the angled portion of the fourth coupler device is coupled to the fourth wheel on the back portion of the frame.

The device can include wherein a second coupler device is coupled to the front portion of the frame and the first and second coupler devices are coupled to a third wheel, such that the first and second coupler devices sandwich the frame and the third wheel.

The device can include wherein at least one of the linear portion of the first coupler device is configured in a rectangular shape, the angled portion of the first coupler device is configured in an oblong shape, one or more spacers are coupled between the frame and the first coupler device, the first hole on the first coupler device is elongated in the x direction or the y direction, and the second hole on the first coupler device is elongated in the x direction or the y direction.

The device can include wherein the first coupler device has an angled piece in the angled portion and the angled piece is angled out in the z direction.

An in-line skate device comprising a boot coupled to a frame, wherein the frame is coupled to at least a first wheel and a second wheel, and wherein the frame is linear in shape and traverses at least a portion of the bottom of the boot, a first coupler device coupled to the frame, wherein the first coupler device includes a linear portion and an angled portion, wherein the linear portion is coupled to the frame, wherein the angled portion has an angle greater than zero.

The device can include wherein the angled portion of the first coupler device varies in range from 1 degree to 90 degrees, the linear portion of the first coupler device varies in length from 1 inch to 25 inches, and the angled portion of the first coupler device varies in length from 1 inch to 25 inches.

The device can include wherein a third wheel is coupled to the angled portion of the first coupler, the third wheel has a diameter that varies in range from 1 inch to 25 inches, and wherein the third wheel comprises one or more of the following a bicycle wheel, automobile tire, wood, plastic, metal, polyurethane, rubber, copolymer plastic, nylon, urethane plastic, and steel.

The device can include wherein the linear portion and the angled portion of the first coupler device have different lengths, wherein the linear portion includes a first hole located near the end of the linear portion that is opposite the angled portion, wherein the angled portion includes a second hole located at an area where the linear portion meets the angled portion, wherein the angled portion has an angle greater than zero, wherein the angled portion includes a third hole near the end of the angled portion that is opposite the linear portion.

The device can include wherein at least one of the first coupler device is coupled to a front portion of the frame and a second coupler device is coupled to the front portion of the frame such that the first and second coupler devices sandwich the frame at the front portion; and a third coupler device is coupled to a back portion of the frame and a fourth coupler device is coupled to the back portion of the frame such that the third and fourth coupler devices sandwich the frame at the back portion.

The device can include wherein at least one of the linear portion of the first coupler device is coupled to the frame on the front portion of the frame and the angled portion of the first coupler device is coupled to a third wheel on the front portion of the frame; and the linear portion of the second coupler device is coupled to the frame on the front portion of the frame and the angled portion of the second coupler device is coupled to the third wheel on the front portion of the frame.

The device can include wherein at least one of the linear portion of the third coupler device is coupled to the frame on the back portion of the frame and the angled portion of the third coupler device is coupled to a fourth wheel on the back portion of the frame; and the linear portion of the fourth coupler device is coupled to the frame on the back portion of the frame and the angled portion of the fourth coupler device is coupled to the fourth wheel on the back portion of the frame.

The device can include wherein a second coupler device is coupled to the front portion of the frame and the first coupler device and the second coupler device are both coupled to a third wheel, such that the first coupler device and the second coupler device sandwich the frame and the third wheel.

The device can include wherein at least one of a snow/ice attachment is coupled to the frame, wherein the snow/ice attachment includes a flat surface, one or more connectors, and a hole through the one or more connectors, and wherein the one or more connectors are coupled to the frame via the hole through the one or more connectors, one or more spacers are coupled between the frame and the first coupler device via one or more holes on the first coupler device, the one or more holes on the first coupler device are elongated in the x direction or the y direction.

The device can include wherein the first coupler device has an angled piece angled out in the z direction.

An exemplary embodiment of the present invention includes an in-line skate device including a boot coupled to a frame. The frame is coupled to at least a first wheel and a second wheel and the frame is linear in shape and traverses at least a portion of the bottom of the boot. A first coupler device is coupled to the frame. The first coupler device includes a linear portion and an angled portion and the linear portion is coupled to the frame and the angled portion has an angle greater than zero.

This exemplary embodiment includes the angled portion of the first coupler device is coupled to a third wheel. The third wheel comprises one or more of the following a bicycle wheel, automobile tire, wood, plastic, metal, polyurethane, rubber, copolymer plastic, nylon, urethane plastic, and steel.

This exemplary embodiment includes the angled portion of the first coupler device varies in range from 5 degrees to 85 degrees and a diameter of the third wheel varies in range from 1 inch to 25 inches.

This exemplary embodiment includes at least one of the first coupler device is coupled to a front portion of the frame and a second coupler device is coupled to the front portion of the frame such that the first and second coupler devices sandwich the frame at the front portion; and a third coupler device is coupled to a back portion of the frame and a fourth coupler device is coupled to the back portion of the frame such that the third and fourth coupler devices sandwich the frame at the back portion.

This exemplary embodiment includes at least one of the linear portion of the first coupler device is coupled to the frame on the front portion of the frame and the angled portion of the first coupler device is coupled to a third wheel on the front portion of the frame; and the linear portion of the second coupler device is coupled to the frame on the front portion of the frame and the angled portion of the second coupler device is coupled to the third wheel on the front portion of the frame.

This exemplary embodiment includes at least one of the linear portion of the third coupler device is coupled to the frame on the back portion of the frame and the angled portion of the third coupler device is coupled to a fourth wheel on the back portion of the frame; and the linear portion of the fourth coupler device is coupled to the frame on the back portion of the frame and the angled portion of the fourth coupler device is coupled to the fourth wheel on the back portion of the frame.

This exemplary embodiment includes a second coupler device is coupled to the front portion of the frame and the first and second coupler devices are coupled to a third wheel, such that the first and second coupler devices sandwich the frame and the third wheel.

This exemplary embodiment includes at least one of one or more spacers are coupled between the frame and the first coupler device and a hole on the first coupler device is elongated in the x direction or the y direction.

This exemplary embodiment includes the first coupler device has an angled piece angled out in the z direction.

An exemplary embodiment of the present invention includes an in-line skate device including a boot coupled to a frame, wherein the frame is coupled to two or more wheels, and wherein the frame is linear in shape and traverses at least a portion of the boot; and a coupler device coupled to the frame, wherein the coupler device is coupled to an additional wheel, wherein the additional wheel is larger than the two or more wheels coupled to the frame.

This exemplary embodiment includes the coupler device includes a linear portion and an angled portion, and wherein the linear portion is coupled to the frame, and wherein the angled portion has an angle greater than zero.

This exemplary embodiment includes the angled portion of the coupler device varies in range from 5 degrees to 85 degrees and a diameter of the additional wheel varies in range from 1 inch to 25 inches.

This exemplary embodiment includes at least one of the coupler device is a first coupler device and is coupled to a front portion of the frame and a second coupler device is coupled to the front portion of the frame such that the first and second coupler devices sandwich the frame at the front portion; and a third coupler device is coupled to a back portion of the frame and a fourth coupler device is coupled to the back portion of the frame such that the third and fourth coupler devices sandwich the frame at the back portion.

This exemplary embodiment includes at least one of the linear portion of the first coupler device is coupled to the frame on the front portion of the frame and the angled portion of the first coupler device is coupled to a third wheel on the front portion of the frame; and the linear portion of the second coupler device is coupled to the frame on the front portion of the frame and the angled portion of the second coupler device is coupled to the third wheel on the front portion of the frame.

This exemplary embodiment includes at least one of the linear portion of the third coupler device is coupled to the frame on the back portion of the frame and the angled portion of the third coupler device is coupled to a fourth wheel on the back portion of the frame; and the linear portion of the fourth coupler device is coupled to the frame on the back portion of the frame and the angled portion of the fourth coupler device is coupled to the fourth wheel on the back portion of the frame.

This exemplary embodiment includes a second coupler device is coupled to the front portion of the frame and the coupler device and the second coupler device are both coupled to a third wheel, such that the coupler device and the second coupler device sandwich the frame and the third wheel.

This exemplary embodiment includes at least one of one or more spacers are coupled between the frame and the coupler device and a hole on the coupler device is elongated in the x direction or the y direction.

This exemplary embodiment includes the additional wheel comprises one or more of the following a bicycle wheel, automobile tire, wood, plastic, metal, polyurethane, rubber, copolymer plastic, nylon, urethane plastic, and steel.

This exemplary embodiment includes the coupler device has an angled piece angled out in the z direction.

An exemplary embodiment of the present invention includes in-line skate device including a boot coupled to a frame, wherein the frame is coupled to at least a first wheel and a second wheel, and wherein the frame is linear in shape and traverses at least a portion of the bottom of the boot; and a snow/ice attachment coupled to the frame, wherein the snow/ice attachment includes a flat surface, one or more connectors, and a hole through the one or more connectors, and wherein the one or more connectors are coupled to the frame via the hole through the one or more connectors.

BRIEF DESCRIPTION OF EXEMPLARY DRAWINGS

Exemplary embodiments of the present invention are described in the context of the appended drawing figures, where like numerals designate like elements:

DETAILED DESCRIPTION OF EXEMPLARY EMBODIMENTS

Figure 1:
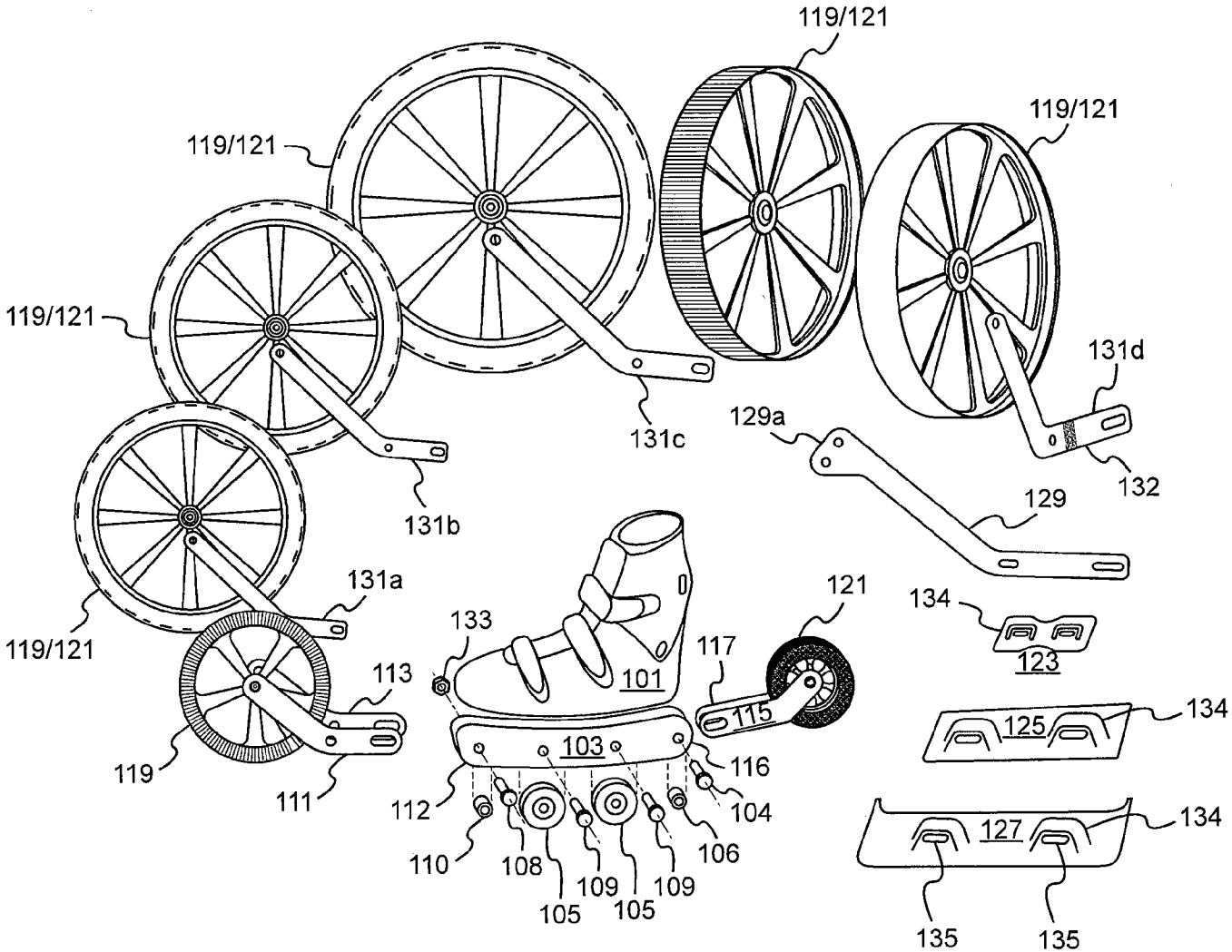
FIG. 1 illustrates an exploded view of an in-line skate 100 in accordance with an exemplary embodiment of the present invention.
Figure 2:
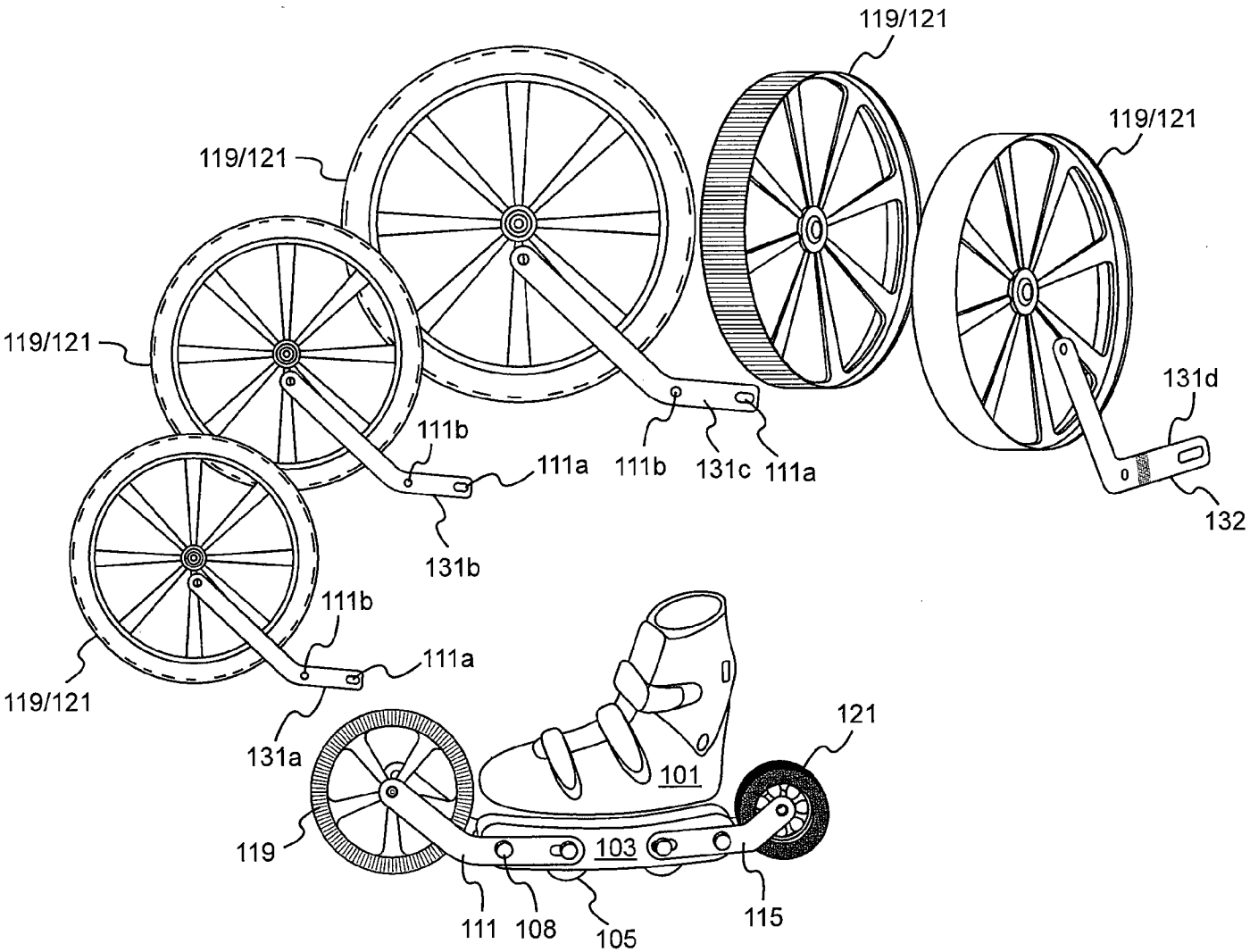
FIG. 2 illustrates a perspective view of an in-line skate 100 in accordance with an exemplary embodiment of the present invention.

The present invention includes a first coupler device and/or a second coupler device for coupling one or more wheels onto at least one of the front end and the back end of the in-line skate. The first coupler device and second coupler device allow the in-line skate to be capable of moving over diverse types of terrain and surfaces. The one or more coupler devices of the present invention can be used for an in-line skate that is "all-terrain" or can move, roll, rotate, or otherwise travel on uneven surfaces. The one or more coupler devices of the present invention can be used with bicycles, skis, and other sports equipment, so that the coupler device allows for attachment of stabilizing devices (wheels, anchors, or other devices) to the sports equipment.

The present invention adds one or more coupler devices and/or one or more additional wheels to an in-line skate, for example, at the front end and/or back end of the in-line skate. The coupler device and/or additional wheel adds stability to the in-line skate, so that the in-line skate can travel over most surfaces (including roads or sidewalks with cracks or bumps, gravel roads or walkways, mountain trails, rocky mountain trails, sand, grass, hills, ice, slushy roads, dirt, mud, or other). By adding the coupler device and/or additional wheel, the center of gravity of the user of the in-line skate is shifted lower. This lower center of gravity provides stability to the user. In addition, varying the size of the one or more coupler devices and/or one or more additional wheels added to the in-line skate allows the in-skate to be used on many diverse and uneven surfaces (that typical in-line skates cannot be used on). The user is less likely to lose balance, fall, or topple over (such as while skating over a pothole or cracks in the road or other surface).

In accordance with an exemplary embodiment of the present invention, as illustrated in FIG. 1, FIG. 2, FIG. 3, FIG. 5, FIG. 7, FIG. 9, FIG. 11, FIG. 13, FIG. 15, and FIG. 16, a first coupler device 111 is configured to couple to the frame 103 of the in-line skate device 100. The first coupler device 111 includes a linear portion Q and an angled portion R and the linear portion Q and the angled portion R have different lengths. The linear portion Q includes a first hole 111*a* configured to couple to the frame 103 via an axle bolt 108 through a hole 103 (or a hole 103*a*) and screwed into an axle nut 133. The first hole 111*a* can be circular, oblong, rectangular, or any other shape (e.g., dragged out hole), which is adjustable in the x direction and varies in size. The first hole 111*a* is located near the end of the linear portion Q that is opposite the angled portion R. The second hole 111*b* can be circular, oblong, rectangular, or any other shape (e.g., dragged out hole), which is adjustable in the x direction and varies in size. The linear portion Q includes a second hole 111*b* located at an area where the linear portion Q meets the angled portion R. The angled portion R has an angle greater than zero. The angled portion R includes a third hole 111*c* near the end of the angled portion R that is opposite the linear portion Q.

A second coupler device 113 is configured to couple to the frame 103 of the in-line skate device 100. The second coupler device 113 includes a linear portion Q and an angled portion R and the linear portion Q and the angled portion R have different lengths. The linear portion Q includes a first hole 113*a* configured to couple to the frame 103 via an axle bolt 108 through a hole 103 (or a hole 103*a*) and screwed into an axle nut 133. The first hole 113*a* is located near the end of the linear portion Q that is opposite the angled portion R. The first hole 113*a* can be circular, oblong, rectangular, or any other shape (e.g., dragged out hole), which is adjustable in the x direction and varies in size. The linear portion Q includes a second hole 113*b* located at an area where the linear portion Q meets the angled portion R. The second hole 113*b* can be circular, oblong, rectangular, or any other shape (e.g., dragged out hole), which is adjustable in the x direction and varies in size. The angled portion R has an angle greater than zero. The angled portion R includes a third hole 113*c* near the end of the angled portion R that is opposite the linear portion Q. Although the second coupler device 113, the first hole 113*a*, the second hole 113*b*, and the third hole 113*c* are not illustrated in many of the figures, these elements are similar to first coupler device 111, first hole 111*a*, second hole 111*b*, and third hole 111*c*.

A third coupler device 115 is configured to couple to the frame 103 of the in-line skate device 100. The third coupler device 115 includes a linear portion Q and an angled portion R and the linear portion Q and the angled portion R have different lengths. The linear portion Q includes a first hole 115*a* configured to couple to the frame 103 via an axle bolt 104 through a hole 103 (or a hole 103*a*) and screwed into an axle nut 133. The first hole 115*a* is located near the end of the linear portion Q that is opposite the angled portion R. The first hole 115*a* can be circular, oblong, rectangular, or any other shape (e.g., dragged out hole), which is adjustable in the x direction and varies in size. The linear portion Q includes a second hole 115*b* located at an area where the linear portion Q meets the angled portion R. The second hole 115*b* can be circular, oblong, rectangular, or any other shape (e.g., dragged out hole), which is adjustable in the x direction and varies in size. The angled portion R has an angle greater than zero. The angled portion R includes a third hole 115*c* near the end of the angled portion R that is opposite the linear portion Q.

A fourth coupler device 117 is configured to couple to the frame 103 of the in-line skate device 100. The fourth coupler device 117 includes a linear portion Q and an angled portion R and the linear portion Q and the angled portion R have different lengths. The linear portion Q includes a first hole 117*a* configured to couple to the frame 103 via an axle bolt 104 through a hole 103 (or a hole 103*a*) and screwed into an axle nut 133. The first hole 117*a* can be circular, oblong, rectangular, or any other shape (e.g., dragged out hole), which is adjustable in the x direction and varies in size. The first hole 117*a* is located near the end of the linear portion Q that is opposite the angled portion R. The linear portion Q includes a second hole 117*b* located at an area where the linear portion Q meets the angled portion R. The second hole 117*b* can be circular, oblong, rectangular, or any other shape (e.g., dragged out hole), which is adjustable in the x direction and varies in size. The angled portion R has an angle greater than zero. The angled portion R includes a third hole 117*c* near the end of the angled portion R that is opposite the linear portion Q.

In accordance with an exemplary embodiment of the present invention, as illustrated in FIG. 1, FIG. 2, FIG. 3, FIG. 5, FIG. 7, FIG. 9, FIG. 11, FIG. 13, FIG. 15, and FIG. 16, an in-line skate 100 comprises a boot (shoe or other foot wear) 101 worn on the foot (not shown), a frame 103 coupled to the boot 101, and two or more wheels 105 coupled to the frame 103. Each wheel 105 has one or more bearings 106 and one or more axles (or axle bolts) 109 (and axle nuts (not shown)), so that it can move, turn, roll, or otherwise rotate on the frame 103 and propel the user (person wearing the in-line skate, not shown) to motion.

Optionally, the in-line skate 100 includes a first coupler device 111 coupled to a front end 112 of the frame 103. Optionally, a second coupler device 113 can also be coupled to the front end 112 of frame 103 (e.g., to securely couple (or sandwich) around frame 103) via one or more holes 103*a*. Coupling or sandwiching the first coupler device 111 and the second coupler device 113 around frame 103, such as with one or more bearings 110 and one or more axles (or axle bolts)

108 (and one or more axle nuts 133) via one or more holes 103*a*, securely connects the first and second coupler devices 111 and 113 to frame 103. The bearings 106 allow the wheels 105 of the in-line skate 100 to rotate freely. The axles 109 can be a common axle, a screw, a bolt, a quick-release bolt, or any other type of attachment for connecting the wheels 105 to the frame 103.

Optionally, the in-line skate 100 includes a third coupler device 115 coupled to a back end 116 of the frame 103 via one or more holes 103*a*. Optionally, a fourth coupler device 117 can also be coupled to the back end 116 of frame 103 via one or more holes 103*a* (e.g., to securely couple (or sandwich) around frame 103). Coupling or sandwiching the third coupler device 115 and the fourth coupler device 117 around frame 103, such as with one or more bearings 106 and one or more axles (or axle bolts) 104 (and one or more axle nuts (not shown)), securely connects the third and fourth coupler devices 115 and 117 to frame 103. One or more of first, second, third, and fourth coupler devices 111, 113, 115, 117 can be coupled to (or sandwiched around) frame 103, for example on the front end 112 and/or the back end 116 of the frame 103, so that the first, second, third, and fourth coupler devices 111, 113, 115, 117 can be anchored to frame 103. The axles 104 can be a common axle, a screw, a bolt, a quick-release bolt, or any other type of attachment for connecting the wheels 105 to the frame 103.

The first coupler device 111 and/or second coupler device 113 are coupled to a front wheel 119 via one or more bearings 110 and axles 108, so that the front wheel 119 is securely anchored to frame 103. See FIG. 2. The third coupler device 115 and/or fourth coupler device 117 are coupled to a back wheel 121 via one or more bearings 106 and axles 104, so that the back wheel 121 is securely anchored to frame 103. See FIG. 2. The axles 108 can be a common axle, a screw, a bolt, a quick-release bolt, or any other type of attachment for connecting the front wheel 119 to the first coupler device 111 and/or second coupler device 113. The axles 104 can be a common axle, a screw, a bolt, a quick-release bolt, or any other type of attachment for connecting the back wheel 121 to the third coupler device 115 and/or fourth coupler device 117. The front wheel 119 can be used alone, the back wheel 121 can be used alone, or the front wheel 119 and the back wheel 121 can be used together. Depending on the activity of the user of the in-line skate 100, various combinations of using the front wheel 119 and/or the back wheel 121 may be beneficial.

The front wheel 119 and the back wheel 121 can vary in size depending on the surface on which the user would like to move, roll, climb, otherwise traverse. For example, the front wheel 119 and the back wheel 121 can range in size of diameter from 1 inch to 25 inches (and in all increments of these sizes). For example, the front wheel 119 and/or the back wheel 121 can be 5 inches in diameter. Using a varying size wheel for the front wheel 119 and/or the back wheel 121 (such as 5 inches or various other sizes) stabilizes the user while using the in-line skate 100. In turn, this can provide a more smooth ride and substantially prevent the user from slowing-down, stopping, falling, toppling over, or otherwise losing control (e.g., even while traveling on uneven surfaces (potholes, cracks, gravel, dirt, sand, or any other surface)).

Varying sizes of first, second, third, and fourth coupler devices 111, 113, 115, 117 are illustrated as item 131*a*, 131*b*, 131*c*, 131*d*, . . . 131*n* (where n is any number or letter) to illustrate using these frames with varying size front wheel 119 and/or back wheel 121 (depending on the activity of the user and the surface on which the user is moving). The coupler device 131*d* has an angled piece 132, which can be angled out in the z direction in order to accommodate front wheel 119 and/or back wheel 121 (that is wider than typical wheels). Each of the coupler devices 111, 113, 115, 117 can be an embodiment of coupler device 131*d* with the angled piece 132, so that coupler devices 111, 113, 115, 117 can be further adjustable for differing size wheels 119/121. For example, the angled piece 132 of the coupler device 131*d* can be angled out in the z direction, so that it is wider in the z direction near wheel 119/121 and narrower (in comparison) near where the coupler device 131*d* attaches to frame 103. For example, the angled piece 132 can be angled out in the z direction at about 1 degree to 90 degrees. The angled piece 132 is illustrated on the right side of hole 111*b* (or 113*b*, 115*b*, or 117*b*); however, the angled piece 132 can be on the left side of the hole 111*b* (or 113*b*, 115*b*, or 117*b*). The angled piece 132 can also be on the right side or left side of hole 111*c* (or 113*c*, 115*c*, or 117*c*). Configuring the coupler devices 111, 113, 115, 117 with the angled piece 132 can eliminate the need for using one or more washers or spacers to be able to accommodate differing size front wheel 119 and/or back wheel 121. It may be preferable to use coupler devices 131*a*, 131*b*, or 131*c* (without the angled piece 132), where the need still exists to have a wider than usual front wheel 119 and/or back wheel 121. In such an embodiment, one or more washers or spacers (not shown) can be coupled between one or more of the coupler devices 131*a*, 131*b*, and 131*c* and the frame 103 to maintain a relatively straight coupler device 131*a*, 131*b*, and 131*c* (without the angled piece 132) while accommodating for the wider than usual wheel 119/121. The one or more washers (or spacers) can be of varying sizes and thicknesses depending on the size of the wheel 119/121. The angled piece 132 can be used with wheels 119/121 for the in-line skate 100 or for wheels on a bicycle, bike trailer, baby stroller, or any other type of wheel (e.g., with a bearing for coupling to frame/item 131*d* or coupler devices 111, 113, 115, or 117).

With reference to FIG. 1, FIG. 2, FIG. 13, FIG. 14, and FIG. 15, various sizes of the front wheel 119 and/or the back wheel 121 can be used. In some cases, one size may work better on roadways or uneven rough roads (e.g., a 5 inch wheel in diameter or a 7 inch wheel in diameter). In other cases, another size may work better on potholes in a road or large cracks in a sidewalk (e.g., a 7 inch wheel in diameter or a 9 inch wheel in diameter). Still in other cases, another size of the front wheel 119 and/or the back wheel 121 may work better depending on the activity the user is participating in (e.g., any diameter ranging from ½ inch (or less) to 30 inches (or more)). A coupler device 129 (in FIG. 1) includes one, two, or more holes on an end 129*a* that connects to the wheel 119/121. The end 129*a* can be in an oblong shape to accommodate one, two, or more holes. The holes can be a distance of about ¼ inch to about 1 inch (or more) depending on the adjustability desired for connecting to the wheel 119/121. These holes on the end 129*a* allow for further adjustability and varying size wheels 119/121 when connecting the coupler device 129 to wheel 119/121 (e.g., to adjust the height of the wheels 119/121 for going over bumpy surfaces and varying terrain).

Figure 3:
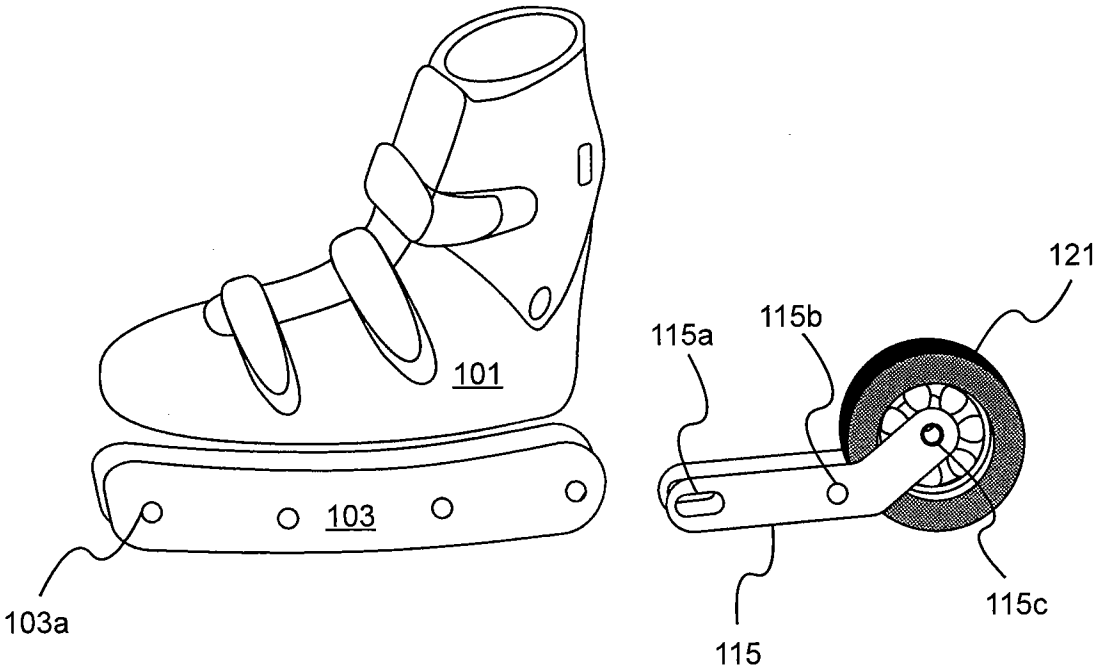
FIG. 3 illustrates a perspective view of an in-line skate 100 in accordance with an exemplary embodiment of the present invention.

In FIG. 3, a hole 115*a* on the coupler device 115 is elongated in the x direction (and/or the y direction), so that the frame 115 can connect at various points along the x direction (and/or the y direction) at the hole 115*a* with frame 103. This adjustability allows for varying size wheels 119/121 to attach to the frame 103 via the coupler device 115. Similarly, a hole 117*a* (not shown in FIG. 3) on the coupler device 117 is elongated in the x direction (and/or the y direction), so that the frame 117 can connect at various points along the x direction (and/or the y direction) at the hole 117*a* with frame 103. In FIG. 5, FIG. 7, FIG. 9, FIG. 11, FIG. 13, and FIG. 15, a hole 111*a* on the coupler device 111 is elongated in the x direction (and/or the y direction), so that the frame 111 can connect at various points along the x direction (and/or the y direction) at the hole 111*a* with frame 103. This adjustability allows for varying size wheels 119/121 to attach to the frame 103 via the coupler device 111. Similarly, a hole 113*a* (not shown in FIG. 5) on the coupler device 113 is elongated in the x direction (and/or the y direction), so that the frame 113 can connect at various points along the x direction (and/or the y direction) at the hole 113*a* with frame 103.

In FIG. 5, FIG. 7, FIG. 9, FIG. 11, FIG. 13, and FIG. 15, the coupler devices 111 and 113 can include one or more additional holes 111*b* and 113*b*, so that frames 111 and 113 can connect with frame 103. The coupler devices 115 and 117 can include one or more additional holes 115*b* and 117*b*, so that frames 115 and 117 can connect with frame 103. The coupler devices 111 and 113 can include one or more additional holes 111*c* and 113*c*, so that coupler devices 111 and 113 can connect with the front wheel 119. The coupler devices 115 and 117 can include one or more additional holes 115*c* and 117*c*, so that frames 115 and 117 can connect with the back wheel 121.

In some embodiments, a wheel with a diameter of 10 inch, 12 inch, or 16 inch for the front wheel 119 and/or the back wheel 121 may travel well for all-terrain activities (e.g., where the surfaces on which the user is using the in-line skate 100 may vary during the activity (sidewalk, then grass, then gravel, then dirt, then back to sidewalk, and so on)). In one embodiment, the front wheel 119 and/or the back wheel 121 can be a bicycle wheel (such as a mountain bike wheel and tire capable of traveling through all-terrain surfaces). If the front wheel 119 and/or the back wheel 121 is a mountain bike wheel and tire, then the in-line skate 100 can be ridden down large hilly mountain trails (with uneven surfaces, varying turns, and varying obstacles to traverse).

In some embodiments, 10 inch, 12 inch, 14 inch, 16 inch, 18 inch, or larger wheel in diameter for the front wheel 119 and/or the back wheel 121 can be used. For example, the front wheel 119 and/or the back wheel 121 can be a flat rubber, such as an automobile wheel and tire. This type of wheel can travel on most surfaces including roads, sidewalks, gravel, grass, snow, sand, and hills (over roads, sidewalks, gravel, grass, snow, and sand). For example, the front wheel 119 and/or the back wheel 121 using a flat rubber (wheel without air) can travel over slush, ice, mud, and other uneven surfaces and during varying weather conditions. In addition, since such a wheel does not have any air, even if it punctures, rips, tears, or otherwise deforms, the wheel can still be used in whatever activity the user is doing.

The in-line skate 100 can also include an optional brake or stopper (not shown) coupled to the front end 112 and/or the back end 116 of either the left or right boot 101. Alternatively, instead of the brake or stopper, the front wheel 119 and/or the back wheel 121 can be dragged on the ground or other surface to slow down the user or bring the user to a stop.

In an exemplary embodiment of the present invention, the in-line skate 100 includes the boot 101 coupled to the frame 103, wherein the frame 103 is coupled to at least a first wheel 105 and a second wheel 105. The frame 103 is linear in shape and traverses at least a portion of the bottom of the boot 101. The first coupler device 111 is coupled to the frame 103. The first coupler device 111 includes a linear portion Q (such as the straight/linear portion of item B in FIG. 4, FIG. 6, FIG. 8, FIG. 10, FIG. 12, and FIG. 14). The first coupler device 111 includes an angled portion R (such as the curved/bent/angled portion of item A in FIG. 4, FIG. 6, FIG. 8, FIG. 10, FIG. 12, and FIG. 14). The linear portion Q is coupled to the frame 103. The angled portion R has an angle M greater than zero. The angled portion Q of the first coupler device 111 is coupled to a third wheel (front wheel 119 or back wheel 121), wherein the third wheel comprises one or more of the following a bicycle wheel, automobile tire, wood, plastic, metal, polyurethane, rubber, copolymer plastic, nylon, urethane plastic, and steel. The angled portion R of the first coupler device 111 varies in range from about 1 degree to 90 degrees. The linear portion Q varies in length from about 1 inch to 25 inches. The angled portion R varies in length from about 1 inch to 25 inches. In an exemplary embodiment, the linear portion Q and the angled portion R have different lengths. A diameter of the third wheel varies in range from about 1 inch to 25 inches. The second coupler device is coupled to the front portion of the frame and the first and second coupler devices 111 and 113 are coupled to the third wheel, such that the first and second coupler devices 111 and 113 sandwich the frame 103 and the third wheel.

In this exemplary embodiment, in-line skate 100 includes at least one of the first coupler device 11 is coupled to a front portion of the frame 103 and the second coupler device 113 is coupled to the front portion of the frame 103 such that the first and second coupler devices 111 and 113 sandwich the frame 103 at the front portion; and the third coupler device 115 is coupled to a back portion of the frame 103 and the fourth coupler device 117 is coupled to the back portion of the frame 103 such that the third and fourth coupler devices 115 and 117 sandwich the frame 103 at the back portion.

In this exemplary embodiment, in-line skate 100 includes at least one of the linear portion Q of the first coupler device 111 is coupled to the frame 103 on the front portion of the frame 103 and the angled portion R of the first coupler device 111 is coupled to a third wheel (front wheel 119 or back wheel 121) on the front portion of the frame 103; and the linear portion Q of the second coupler device 113 is coupled to the frame 103 on the front portion of the frame 103 and the angled portion R of the second coupler device 113 is coupled to the third wheel on the front portion of the frame 103.

In this exemplary embodiment, in-line skate 100 includes at least one of the linear portion Q of the third coupler device 115 is coupled to the frame 103 on the back portion of the frame 103 and the angled portion R of the third coupler device 115 is coupled to a fourth wheel (front wheel 119 or back wheel 121) on the back portion of the frame 103; and the linear portion Q of the fourth coupler device 117 is coupled to the frame 103 on the back portion of the frame 103 and the angled portion R of the fourth coupler device 117 is coupled to the fourth wheel on the back portion of the frame 103.

In one exemplary embodiment, in-line skate 100 includes at least one of one or more spacers are coupled between the frame 103 and the first coupler device 111 and a hole on the first coupler device 111 is elongated in the x direction or the y direction. The first coupler device 111 has an angled piece 132 angled out in the z direction.

In FIG. 4, FIG. 6, FIG. 8, FIG. 10, FIG. 12, and FIG. 14: A is the length of the coupler device; B is the length of the coupler device (and can be different from A depending on the angle L illustrated); C is the height of the coupler device; D is a distance between the end of the coupler device and the first hole on the coupler device (through which the bearing and axle can secure the coupler device to frame 103); E is the height of the first hole on the coupler device (through which the bearing and axle can secure the coupler device to frame 103); F is the length of the first hole on the coupler device (through which the bearing and axle can secure the coupler device to frame 103); G is the distance between the bottom of the coupler device and the first hole on the coupler device (through which the bearing and axle can secure the coupler device to frame 103); H is the distance between the top of the coupler device and the first hole on the coupler device (through which the bearing and axle can secure the coupler device to frame 103); I is the distance between the first hole and a second hole on the coupler device; J is the distance between the bottom of the coupler device and the second hole on the coupler device (through which the bearing and axle can secure the coupler device to frame 103); K is the length of the second hole on the coupler device (through which the bearing and axle can secure the coupler device to frame 103); L is the angle relative to a horizontal axis at which the coupler device is bent in order to accommodate the front wheel 119 and/or back wheel 121; M is 180 degrees minus the angle in L; N is the diameter of a third hole on the coupler device; O is the distance from the end of the coupler device to the third hole; P is the height of the coupler device at the point where part of the coupler device is angled (or bent) to accommodate front wheel 119 and/or back wheel 121; Q is a linear portion of each coupler device (first coupler device 111, second coupler device 113, third coupler device 115, and/or fourth coupler device 117 (such as the straight/linear portion of item B in FIG. 4, FIG. 6, FIG. 8, FIG. 10, FIG. 12, and FIG. 14)); and R is an angled portion of each coupler device (first coupler device 111, second coupler device 113, third coupler device 115, and/or fourth coupler device 117 (such as the curved/bent/angled portion of item A in FIG. 4, FIG. 6, FIG. 8, FIG. 10, FIG. 12, and FIG. 14)). All of items A through R can vary in length or degrees and are not bound by the exemplary embodiments illustrated herein.

Figure 4:
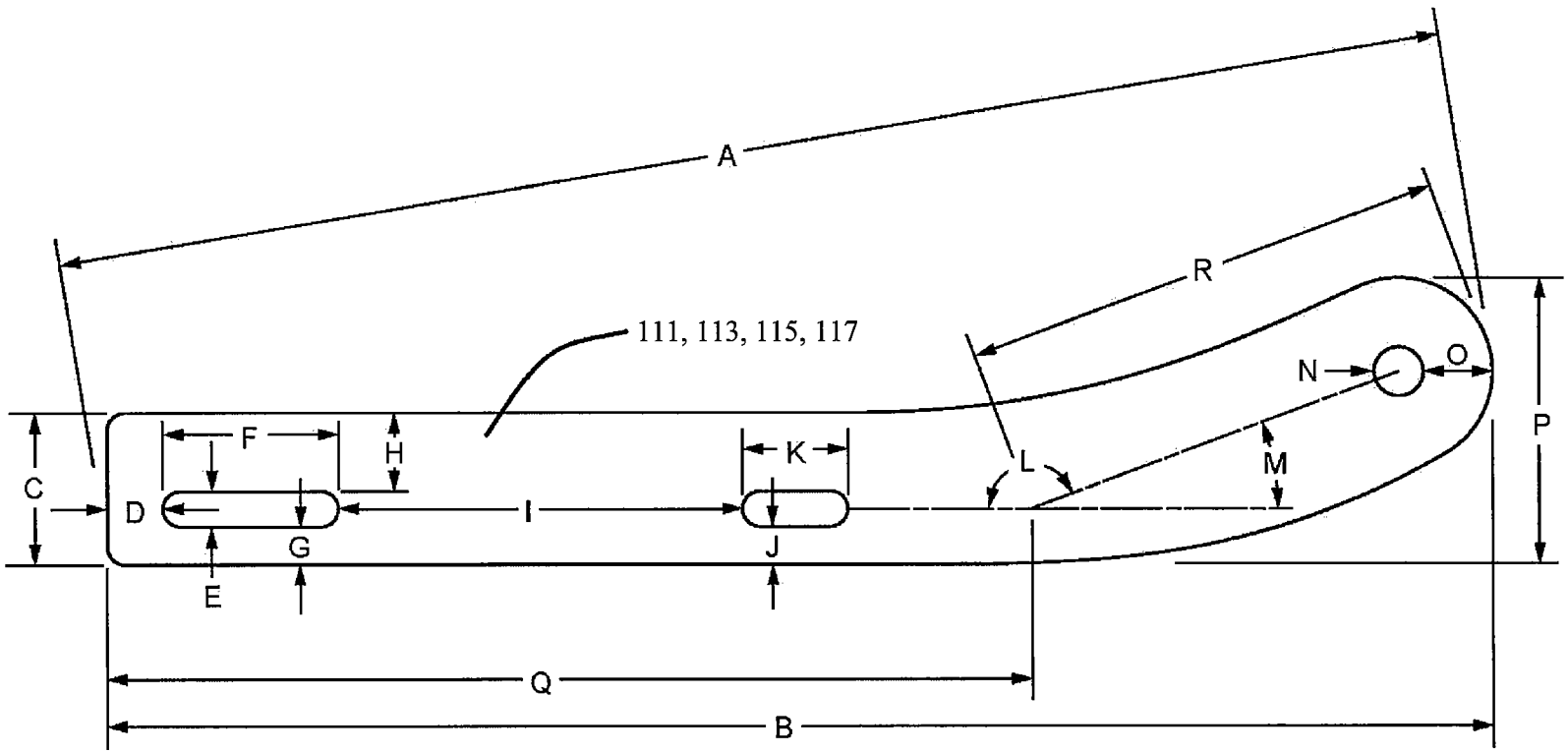
FIG. 4 illustrates a perspective view of a coupler device 111, 113, 115, or 117 in accordance with an exemplary embodiment of the present invention.

In the exemplary embodiment of FIG. 3 and FIG. 4, in-line skate 100 is illustrated with back wheel 121 sized to 5 inches (although back wheel 121 can be any size). The third coupler device 115 and/or the fourth coupler device 117 (not shown FIG. 3) can be sized to correlate with a 5 inch back wheel 121 as illustrated in FIG. 4 (or third coupler device 115 and/or fourth coupler device 117 can be any size). For example, the third coupler device 115 and/or the fourth coupler device 117 can have the following dimensions: A=9½ inches, B=9½ inches, C=1 inch, D=⅜ inches, E=6.5 millimeters, F=1¼ inches, G=5.5 millimeters, H=½ inch, I=2¾ inches, J=5.5 millimeters, K=⅝ inch, L=160 degrees, M=20 degrees, N=5/16 inches in diameter, O=½ inch, P=1 29/32 inches, linear portion Q=6¾ inches, and angled portion R=3⅞ inches. This embodiment of in-line skate 100 is illustrated with the back wheel 121, but a similar embodiment can include the front wheel 119 or both back wheel 121 and front wheel 119.

Figure 5:
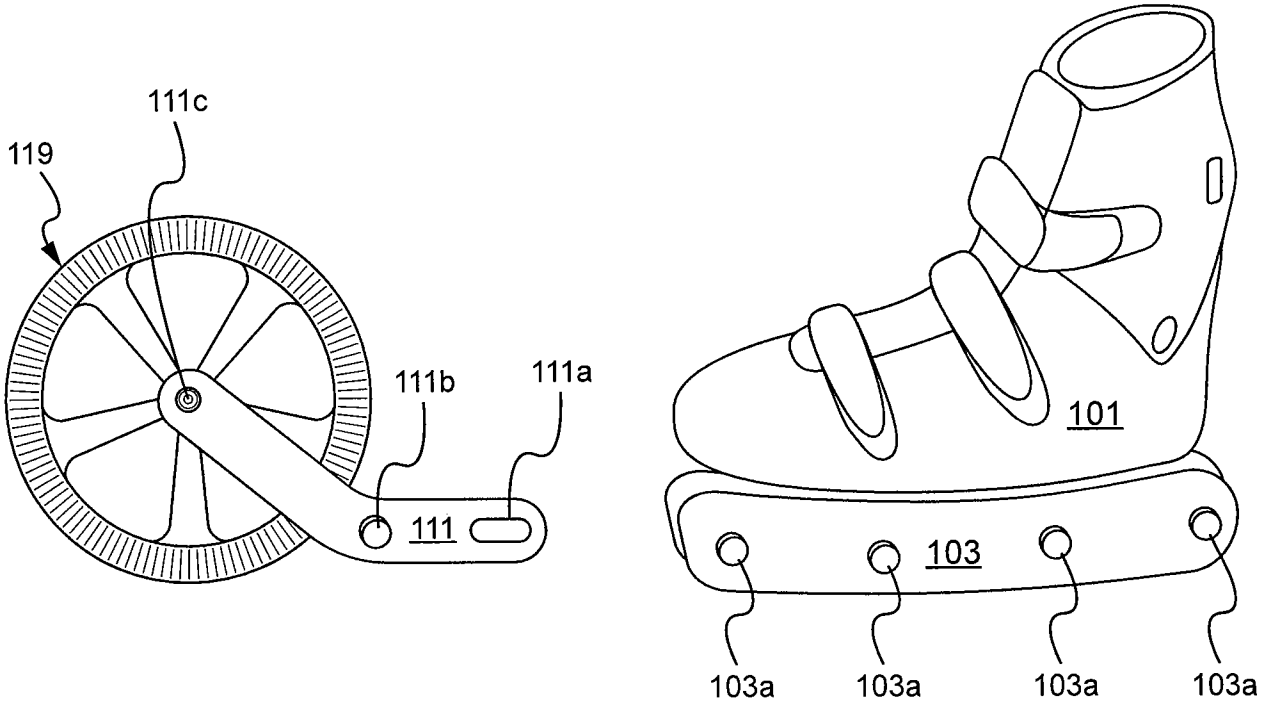
FIG. 5 illustrates a perspective view of an in-line skate 100 in accordance with an exemplary embodiment of the present invention.
Figure 6:
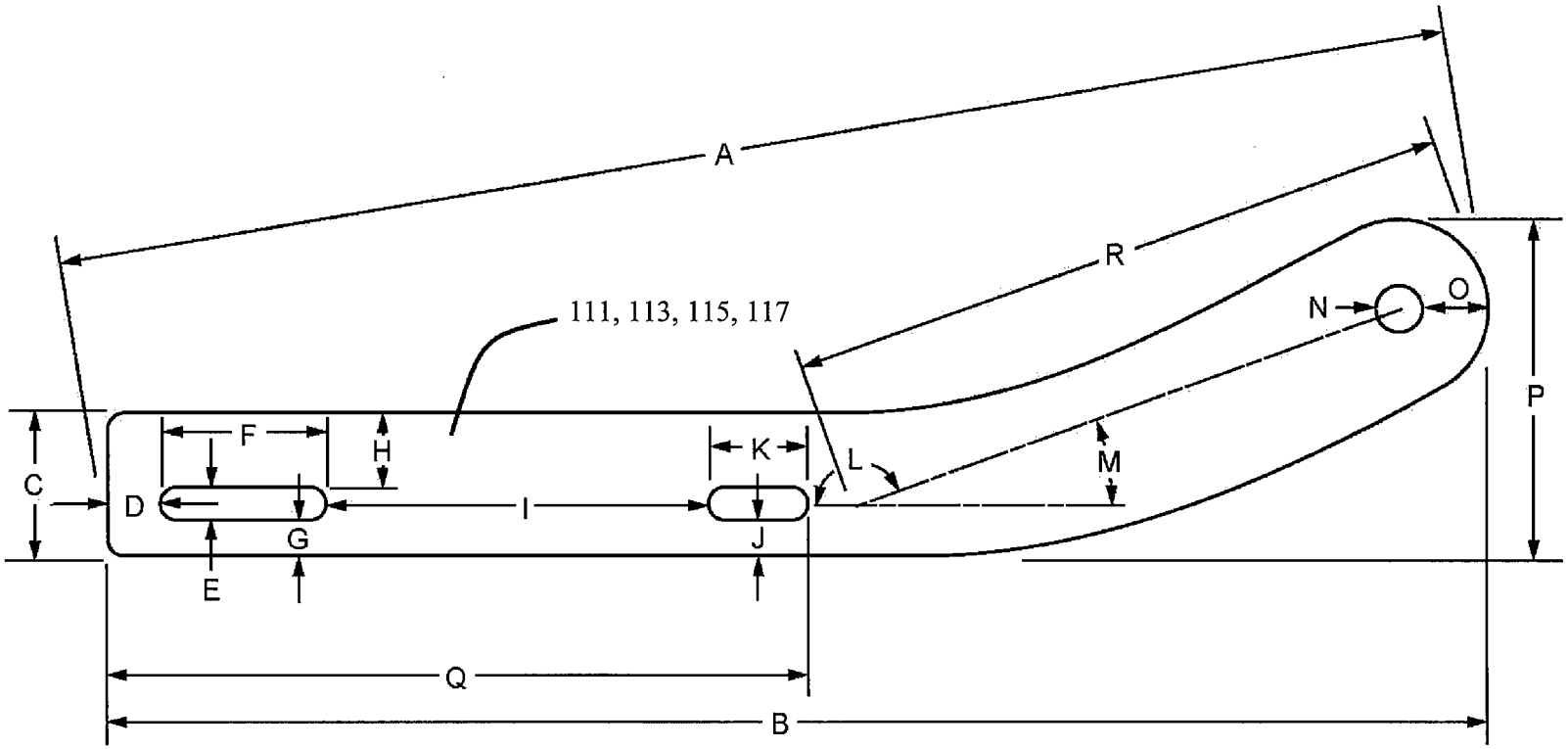
FIG. 6 illustrates a perspective view of a coupler device 111, 113, 115, or 117 in accordance with an exemplary embodiment of the present invention.

In the exemplary embodiment of FIG. 5 and FIG. 6, in-line skate 100 is illustrated with front wheel 119 sized to 7 inches (although front wheel 119 can be any size). The first coupler device 111 and/or the second coupler device 113 (not shown FIG. 5) can be sized to correlate with a 7 inch front wheel 119 as illustrated in FIG. 6 (or first coupler device 111 and/or second coupler device 113 can be any size). For example, the first coupler device 111 and/or the second coupler device 113 can have the following dimensions: A=10 1/16 inches, B=9 30/32 inches, C=1 inch, D=⅜ inches, E=6.5 millimeters, F=1¼ inches, G=5.5 millimeters, H=½ inch, I=2¾ inches, J=5.5 millimeters, K=⅝ inch, L=160 degrees, M=20 degrees, N=5/16 inches in diameter, O=½ inch, P=2 7/16 inches, linear portion Q=5¼ inches, and angled portion R=5¼ inches. This embodiment of in-line skate 100 is illustrated with the front wheel 119, but a similar embodiment can include the back wheel 121 or both the front wheel 119 and back wheel 121.

Figure 7:
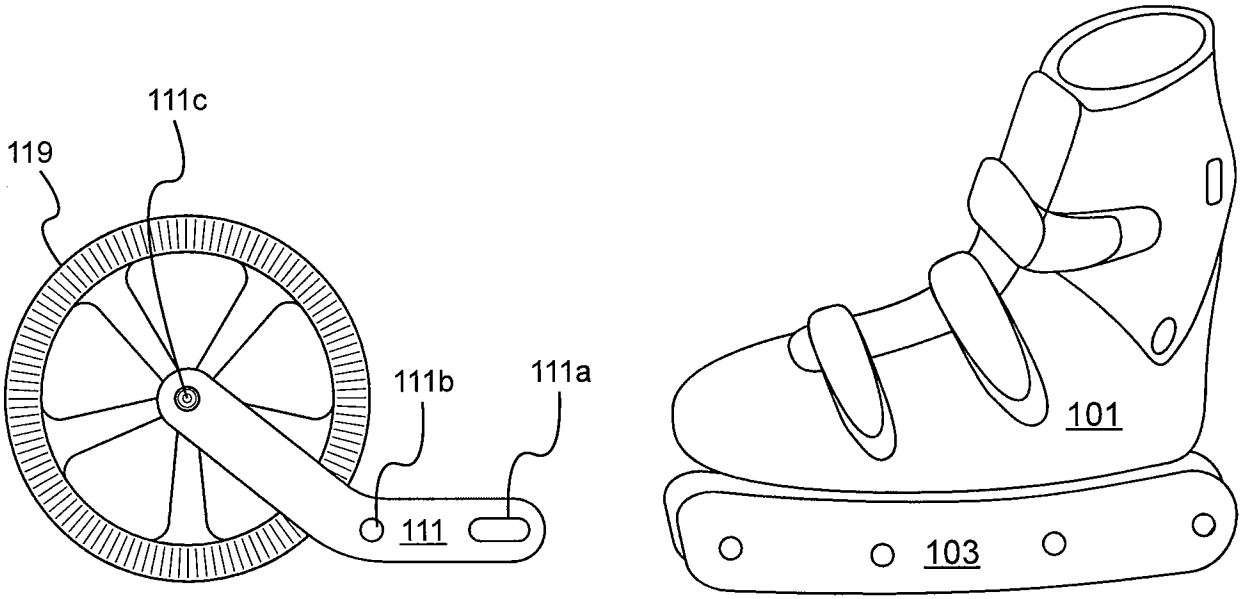
FIG. 7 illustrates a perspective view of an in-line skate 100 in accordance with an exemplary embodiment of the present invention.
Figure 8:
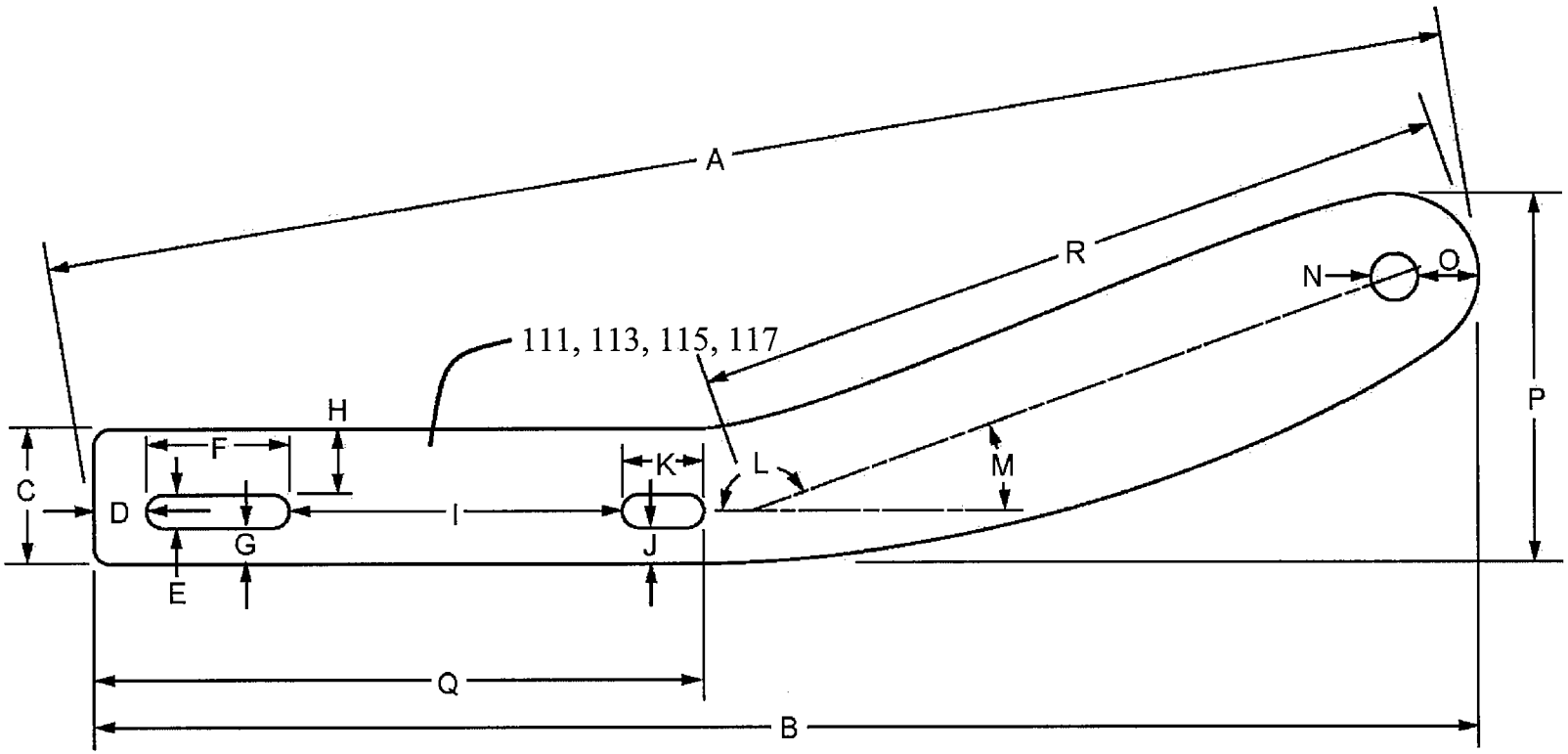
FIG. 8 illustrates a perspective view of a coupler device 111, 113, 115, or 117 in accordance with an exemplary embodiment of the present invention.

In the exemplary embodiment of FIG. 7 and FIG. 8, in-line skate 100 is illustrated with front wheel 119 sized to 9 inches (although front wheel 119 can be any size). The first coupler device 111 and/or the second coupler device 113 (not shown FIG. 7) can be sized to correlate with a 9 inch front wheel 119 as illustrated in FIG. 8 (or first coupler device 111 and/or second coupler device 113 can be any size). For example, the first coupler device 111 and/or the second coupler device 113 can have the following dimensions: A=11½ inches, B=11 5/16 inches, C=1 inch, D=⅜ inches, E=6.5 millimeters, F=1½ inches, G=5.5 millimeters, H=½ inch, I=2¾ inches, J=5.5 millimeters, K=⅝ inch, L=159 degrees, M=21 degrees, N=⅜ inches in diameter, O=7/16 inch, P=3 1/16 inches, linear portion Q=5½ inches, and angled portion R=6⅜ inches. This embodiment of in-line skate 100 is illustrated with the front wheel 119, but a similar embodiment can include the back wheel 121 or both the front wheel 119 and back wheel 121.

Figure 9:
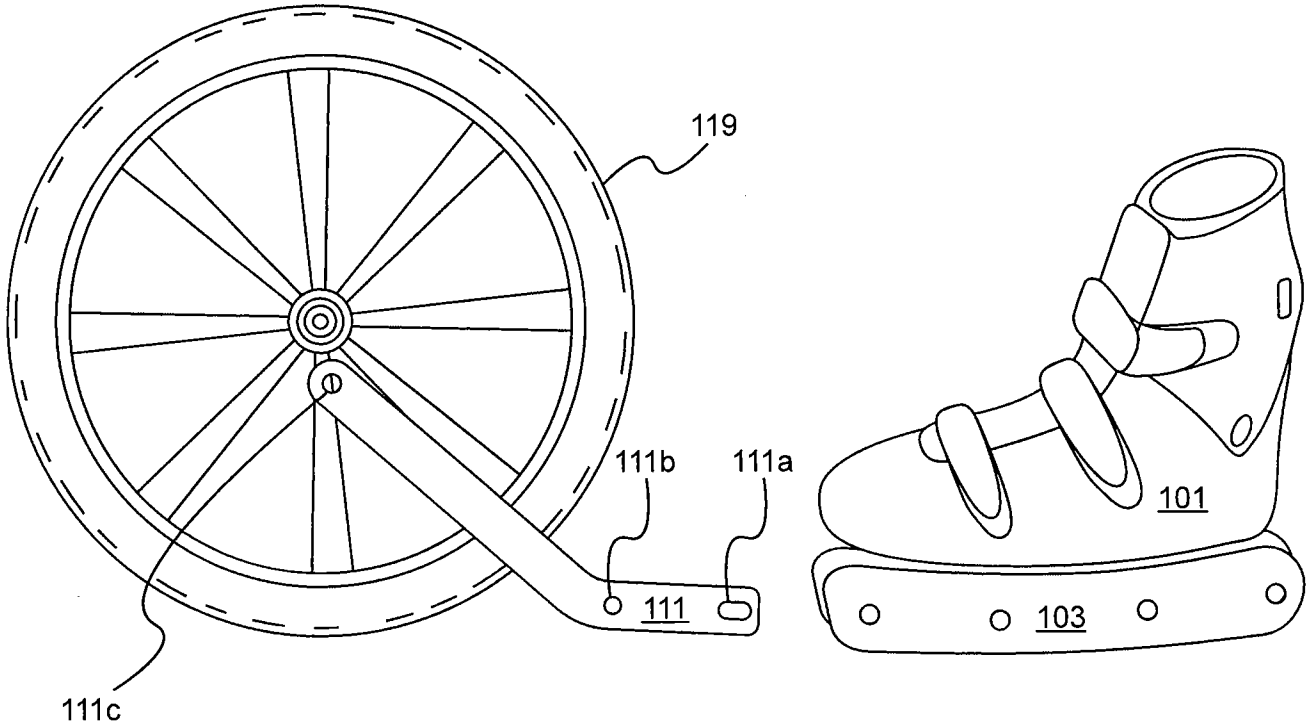
FIG. 9 illustrates a perspective view of an in-line skate 100 in accordance with an exemplary embodiment of the present invention.
Figure 10:
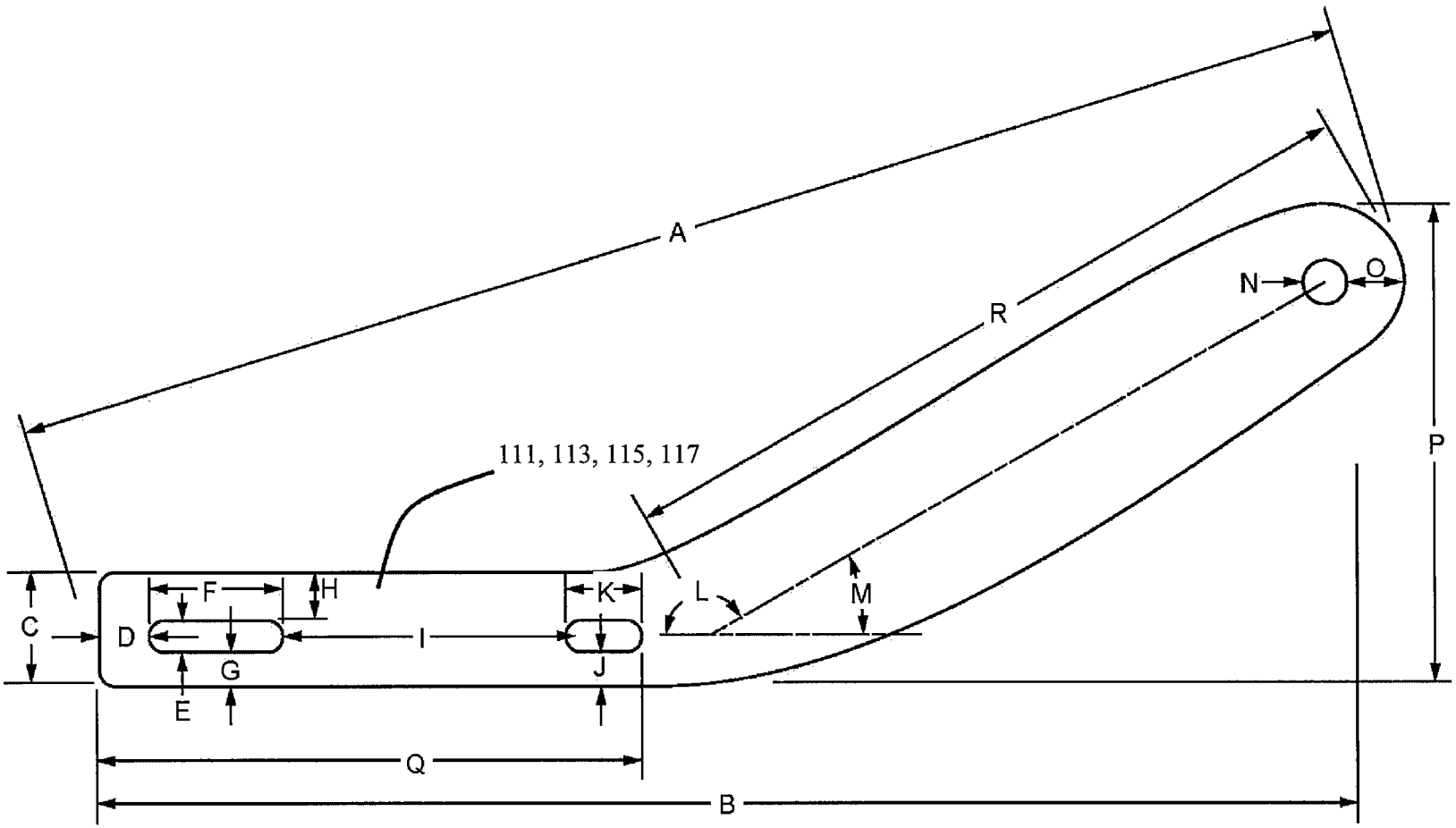
FIG. 10 illustrates a perspective view of a coupler device 111, 113, 115, or 117 in accordance with an exemplary embodiment of the present invention.

In the exemplary embodiment of FIG. 9 and FIG. 10, in-line skate 100 is illustrated with front wheel 119 sized to 12 inches (although front wheel 119 can be any size). The first coupler device 111 and/or the second coupler device 113 (not shown FIG. 9) can be sized to correlate with a 12 inch front wheel 119 as illustrated in FIG. 10 (or first coupler device 111 and/or second coupler device 113 can be any size). For example, the first coupler device 111 and/or the second coupler device 113 can have the following dimensions: A=12¾ inches, B=12 5/32 inches, C=1 inch, D=⅜ inches, E=6.5 millimeters, F=1¼ inches, G=5.5 millimeters, H=½ inch, I=2¾ inches, J=5.5 millimeters, K=⅝ inch, L=150 degrees, M=30 degrees, N=⅜ inches in diameter, O=7/16 inch, P=4 19/32 inches, linear portion Q=5 inches, and angled portion R=7⅞ inches. This embodiment of in-line skate 100 is illustrated with the front wheel 119, but a similar embodiment can include the back wheel 121 or both the front wheel 119 and back wheel 121.

Figure 11:
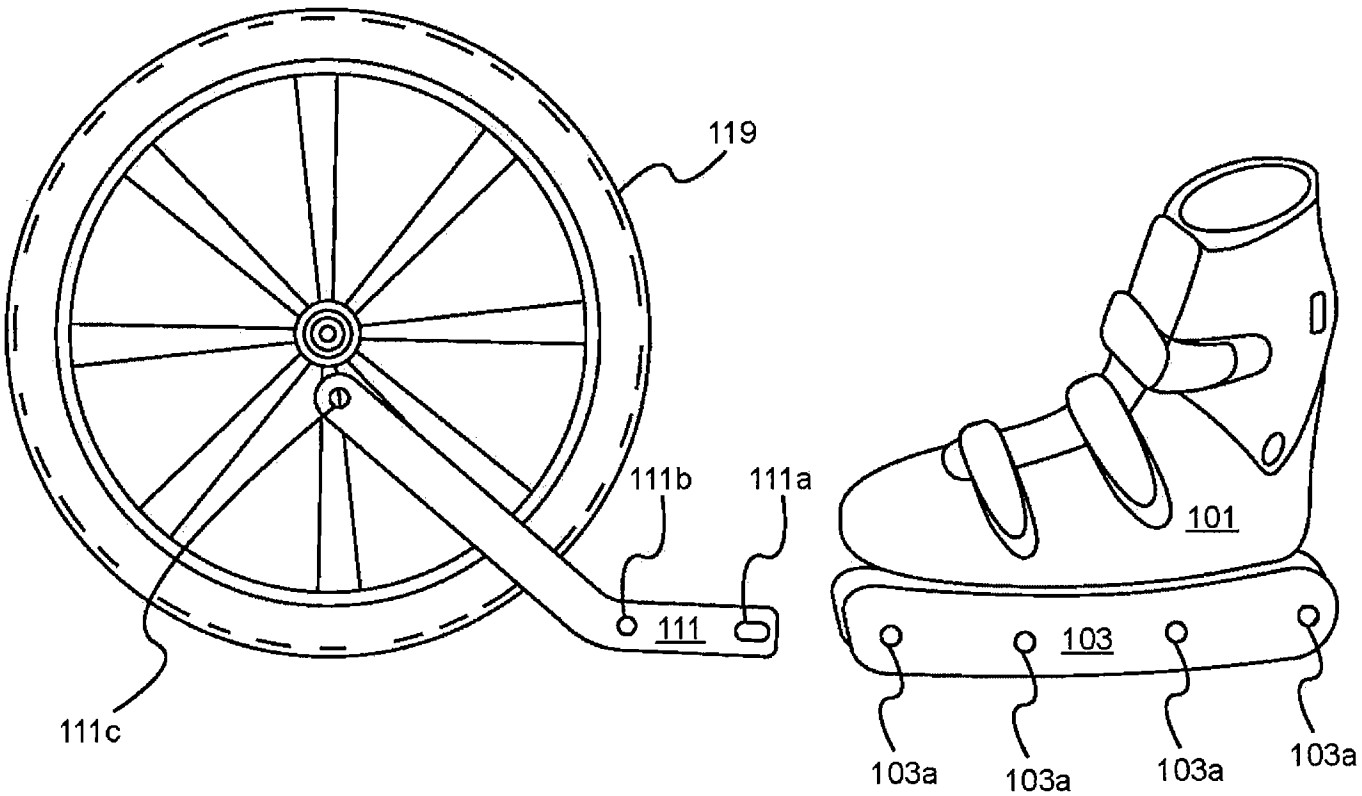
FIG. 11 illustrates a perspective view of an in-line skate 100 in accordance with an exemplary embodiment of the present invention.
Figure 12:
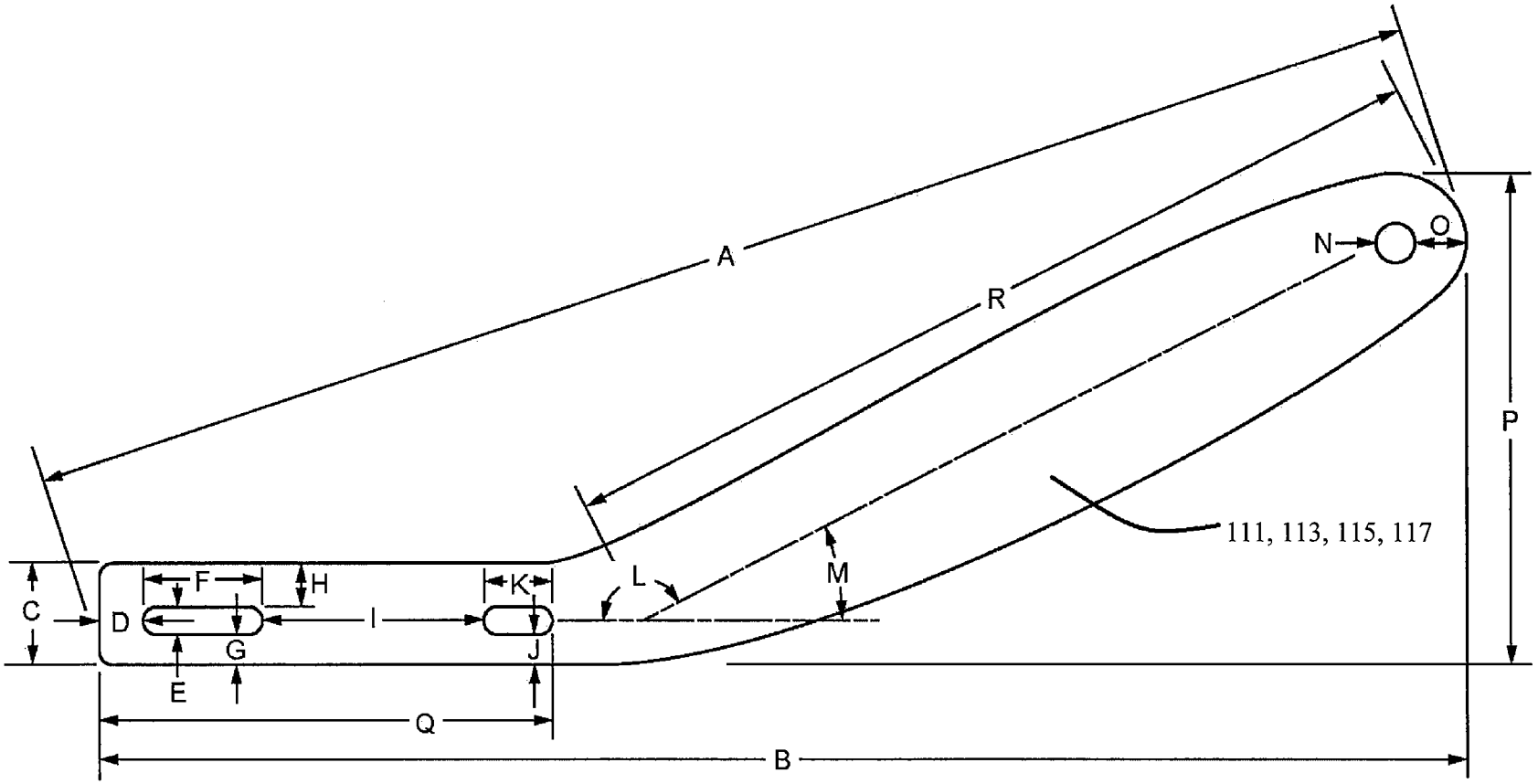
FIG. 12 illustrates a perspective view of a coupler device 111, 113, 115, or 117 in accordance with an exemplary embodiment of the present invention.

In the exemplary embodiment of FIG. 11 and FIG. 12, in-line skate 100 is illustrated with front wheel 119 sized to 16 inches (although front wheel 119 can be any size). The first coupler device 111 and/or the second coupler device 113 (not shown FIG. 11) can be sized to correlate with a 16 inch front wheel 119 as illustrated in FIG. 12 (or first coupler device 111 and/or second coupler device 113 can be any size). For example, the first coupler device 111 and/or the second coupler device 113 can have the following dimensions: A=15⅝ inches, B=14⅞ inches, C=1 inch, D=⅜ inches, E=6.5 millimeters, F=1¼ inches, G=5.5 millimeters, H=½ inch, I=2¾ inches, J=5.5 millimeters, K=⅝ inch, L=152 degrees, M=28 degrees, N=⅜ inches in diameter, O=7/16 inch, P=5 7/16 inches, linear portion Q=5¼ inches, and angled portion R=10⅝ inches. This embodiment of in-line skate 100 is illustrated with the front wheel 119, but a similar embodiment can include the back wheel 121 or both the front wheel 119 and back wheel 121.

Figure 13:
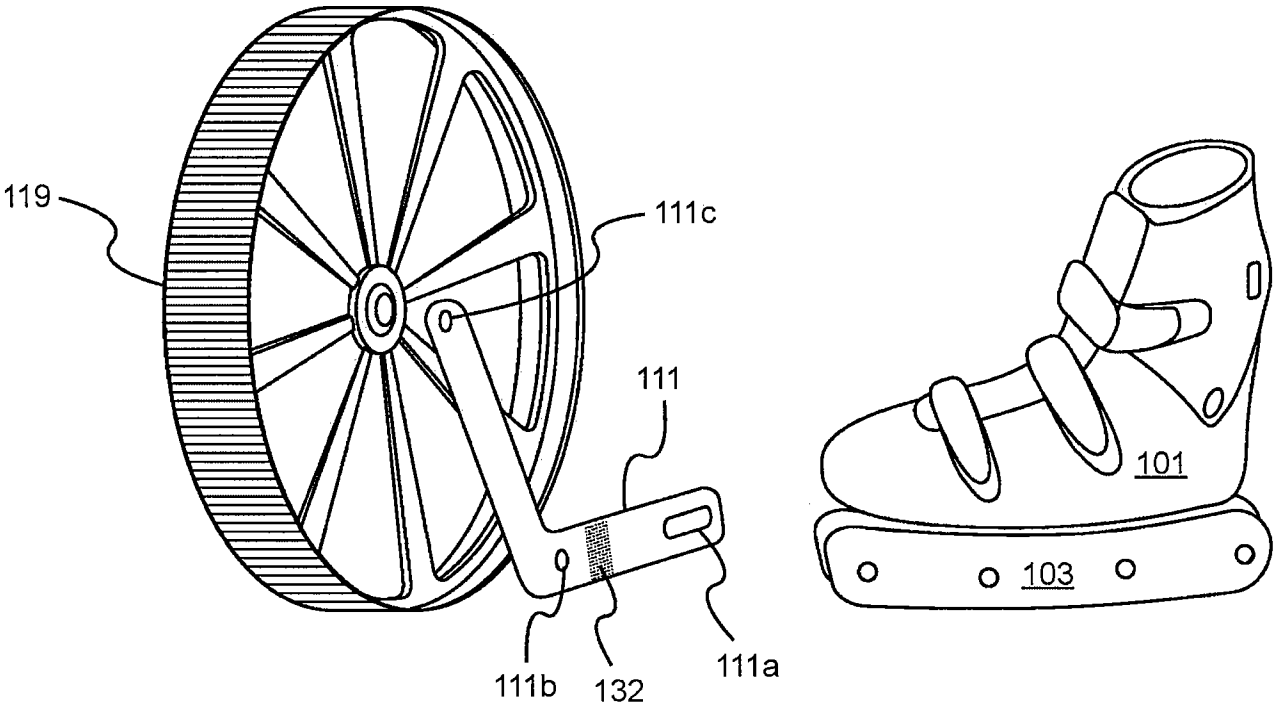
FIG. 13 illustrates a perspective view of an in-line skate 100 in accordance with an exemplary embodiment of the present invention.
Figure 14:
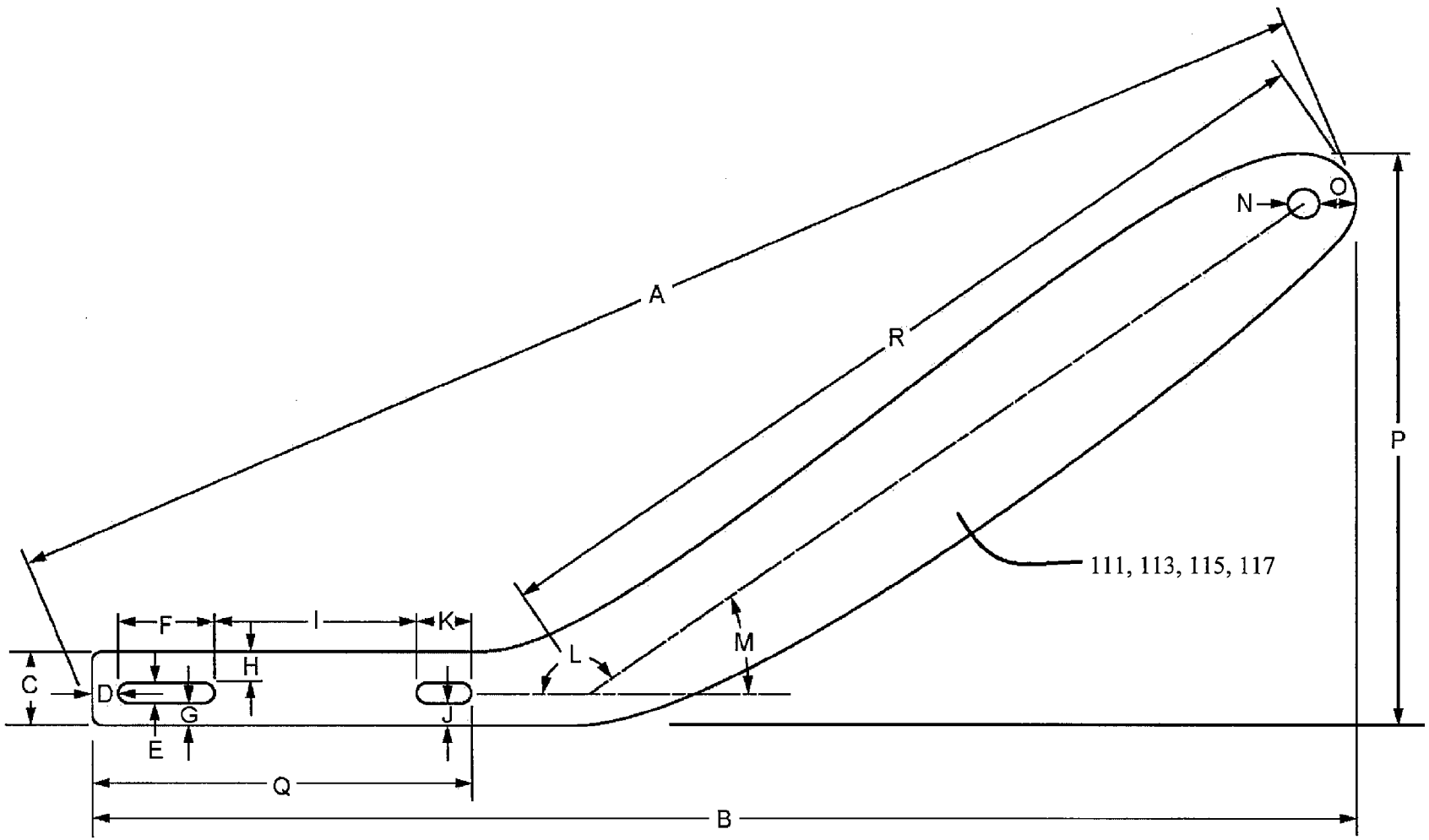
FIG. 14 illustrates a perspective view of a coupler device 111, 113, 115, or 117 in accordance with an exemplary embodiment of the present invention.

In the exemplary embodiment of FIG. 13 and FIG. 14, in-line skate 100 is illustrated with front wheel 119 sized to 18 inches (although front wheel 119 can be any size). The first coupler device 111 and/or the second coupler device 113 (not shown FIG. 13) can be sized to correlate with an 18 inch front wheel 119 as illustrated in FIG. 14 (or first coupler device 111 and/or second coupler device 113 can be any size). For example, the first coupler device 111 and/or the second coupler device 113 can have the following dimensions: A=18¼ inches, B=16 19/32 inches, C=1 inch, D=⅜ inches, E=6.5 millimeters, F=1¼ inches, G=5.5 millimeters, H=½ inch, I=2¾ inches, J=5.5 millimeters, K=⅝ inch, L=142 degrees, M=38 degrees, N=⅜ inches in diameter, O=7/16 inch, P=8¼ inches, linear portion Q=6¼ inches, and angled portion R=13¼ inches. This embodiment of in-line skate 100 is illustrated with the front wheel 119, but a similar embodiment can include the back wheel 121 or both the front wheel 119 and back wheel 121.

As illustrated in FIG. 3, FIG. 4, FIG. 5, FIG. 6, FIG. 7, FIG. 8, FIG. 9, FIG. 10, FIG. 11, FIG. 12, FIG. 13, and FIG. 14, the linear portion Q can be the same length in all the examples (or it can be different lengths) and the angled portion R can the same length in all the examples (or it can be different lengths).

Figure 15:
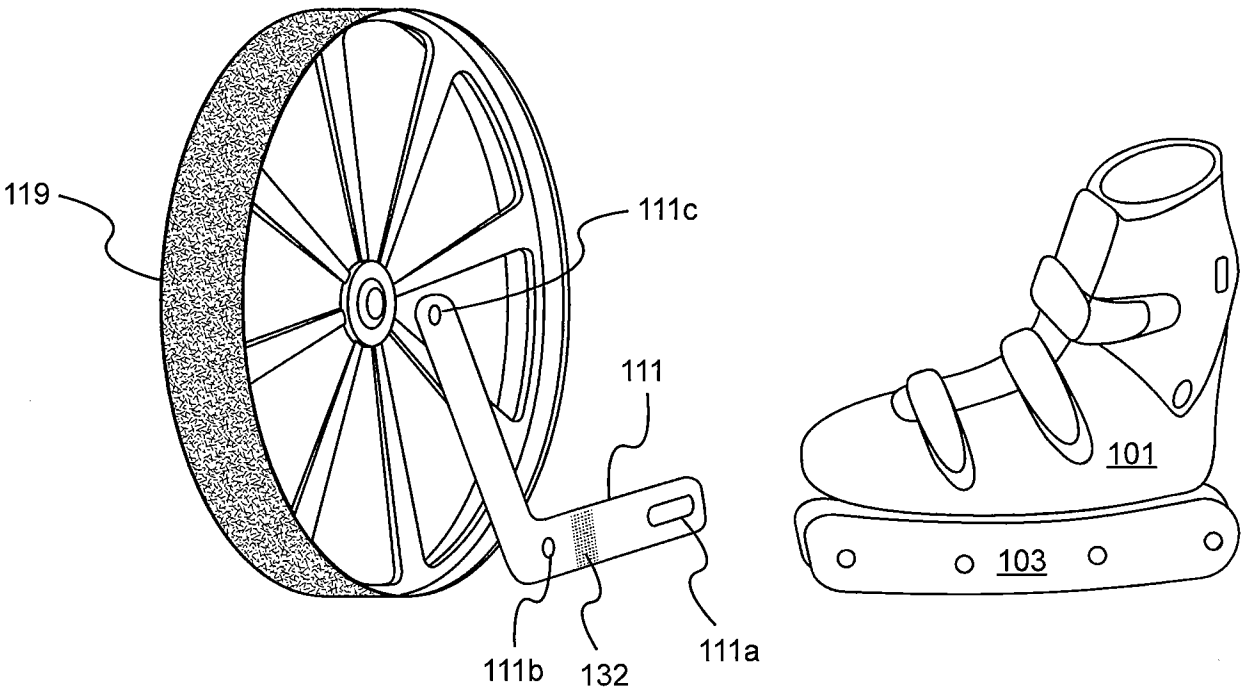
FIG. 15 illustrates a perspective view of an in-line skate 100 in accordance with an exemplary embodiment of the present invention.
Figure 16:
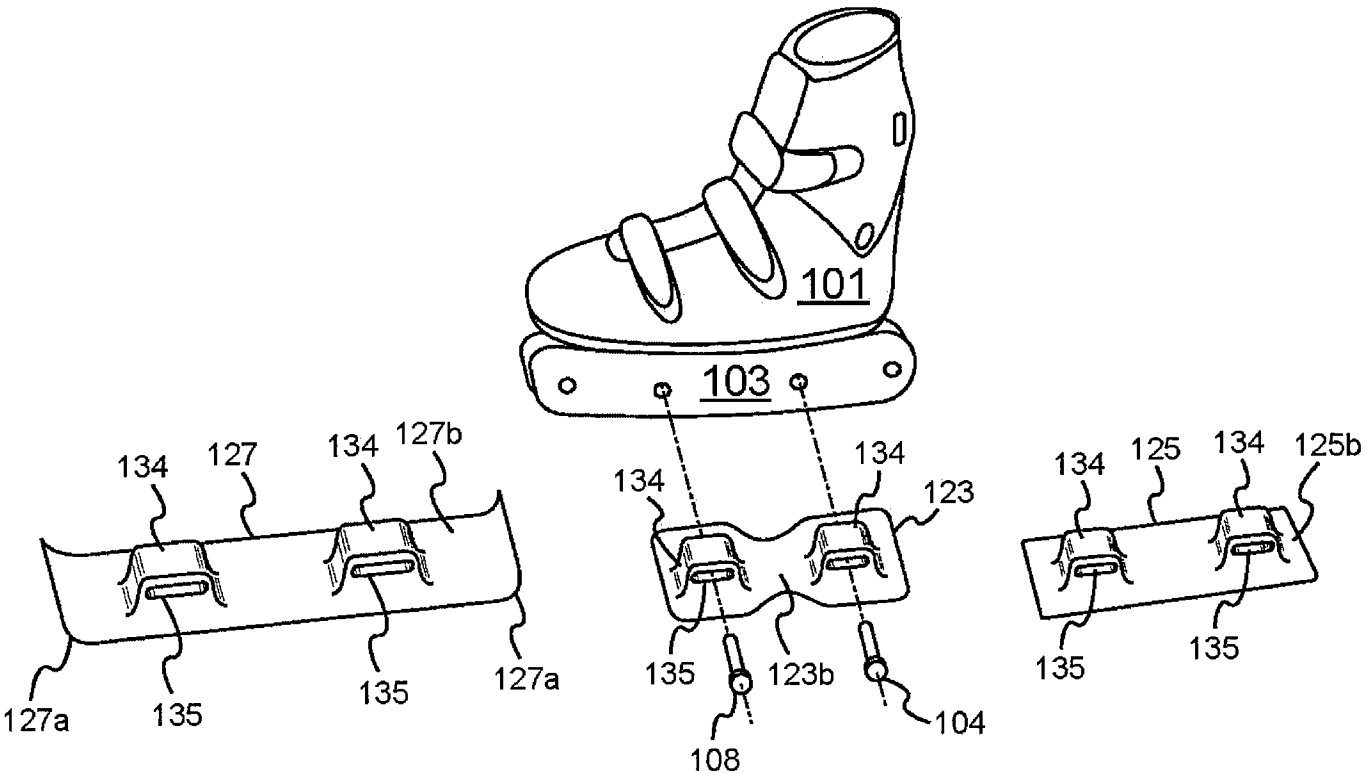
FIG. 16 illustrates an exploded view of an in-line skate 100 and a snow/ice attachment 123, 125, or 127 in accordance with an exemplary embodiment of the present invention.

In some embodiments, the front wheel 119 and/or the back wheel 121 can be flat in shape as illustrated in FIG. 15. In this embodiment, the front wheel 119 and/or the back wheel 121 can be made of hard plastic(s) (such as the type of plastic used in snow skies), hard rubber (such as the type of rubber used in automobile tires), or any other material used on wheels or tires. When the front wheel 119 and/or the back wheel 121 is made of a hard plastic, a hard rubber, metal, another material used in making wheels or tires, or a combination of any of these, then the front wheel 119 and/or the back wheel 121 do not require any air. In this way, the front wheel 119 and/or the back wheel 121 cannot puncture or get a hole, so that they are versatile for rolling/moving over various diverse surfaces. The first, second, third, and fourth coupler devices 111, 113, 115, 117 can be made of plastic, metal, wood, or a combination of these materials, or any other durable material. This embodiment can be used for packed snow, roads with ice, hills and hill sides, grass, sand, and hills with sand. In one embodiment, the front wheel 119 can be from 12 inches to 20 inches in diameter and/or the back wheel 121 can be from 12 inches to 20 inches in diameter.

In an exemplary embodiment illustrated in FIG. 1, FIG. 16, FIG. 17, FIG. 18, and FIG. 19, the in-line skate 100 can include an optional snow/ice attachment 123, 125, or 127 (these snow/ice attachments 123, 125, or 127 vary depending on the size desired (e.g., for a child or an adult, for differing surfaces, or as a preference by the user)). The snow/ice attachment 123, 125, or 127 each have a flat surface 123*b*, 125*b*, and 127*b*, respectively. One or more snow/ice attachments 123, 125, or 127 can couple directly to frame 103 (i.e., so that one or more wheels 105, first, second, third, and fourth coupler devices 111, 113, 115, 117, front wheel 119 and/or back wheel 121 would not be used while the snow/ice attachments 123, 125, or 127 are attached to frame 103). Alternatively, one or more snow/ice attachments 123, 125, or 127 can couple to frame 103 (i.e., while one or more wheels 105, first, second, third, and fourth coupler devices 111, 113, 115, 117, front wheel 119 and/or back wheel 121 are also attached to frame 103). The snow/ice attachments 123, 125, or 127 couple securely to the frame 103 using one or more bearings 106 and one or more axles 109 (and axle nuts (not shown)). The snow/ice attachment 123, 125, or 127 couples securely to the first, second, third, and fourth coupler devices 111, 113, 115, 117 using one or more bearings 106 and one or more axles 109 (and axle nuts (not shown)). The snow/ice attachment 123, 125, or 127 includes one or more connectors 134 to aid in securely coupling to the frame 103 and/or first, second, third, and fourth coupler devices 111, 113, 115, and 117. The one or more connectors 134 have an opening (or hole) 135 through which axle 109 can secure the snow/ice attachment 123, 125, or 127 to the frame 103 and/or first, second, third, and fourth coupler devices 111, 113, 115, and 117.

In this exemplary embodiment, the in-line skate 100 includes the boot 101 coupled to the frame 103, wherein the frame 103 is coupled to at least the first wheel 105 and the second wheel 105. The frame 103 is linear in shape and traverses at least a portion of the bottom of the boot 101. The snow/ice attachment 123, 125, or 127 is coupled to the frame 103. The snow/ice attachment 123, 125, or 127 includes the flat surface 123*b*, 125*b*, and 127*b*, one or more connectors 134, and the opening 135 through the one or more connectors 134, and wherein the one or more connectors 134 are coupled to the frame 103 via the opening 135 through the one or more connectors 134.

The snow/ice attachment 123, 125, or 127 can travel on snow, ice, water, rain, wet surfaces, gravel, grass, sand, or any other surface. In one embodiment, snow/ice attachment 123 is preferred for rocky trails, gravel, and grass. In another embodiment, snow/ice attachment 125 is preferred for most activities. In another embodiment, snow/ice attachment 127 is preferred for snow, ice, sand, dirt, grass, and gravel. The snow/ice attachment 127 has a lip 127*a* on each end that aids in keeping any snow, ice, sand, grass, gravel, or other terrain from interfering with the rotation of wheels 105 or front wheel 119 and/or back wheel 121. The lip 127*a* and/or snow/ice attachment 123, 125, or 127 can help guard frame 103 and wheels 105 when traveling over various and differing terrains.

Figure 17:
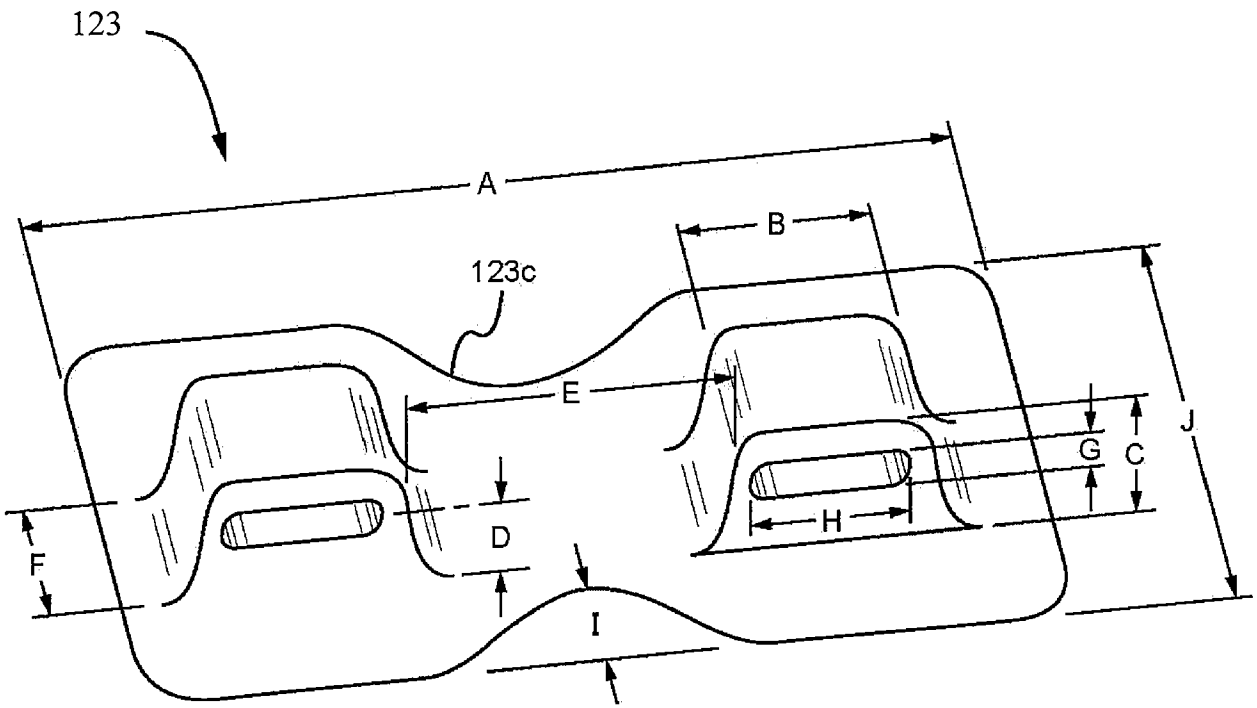
FIG. 17 illustrates a perspective view of a snow/ice attachment 123 in accordance with an exemplary embodiment of the present invention.
Figure 18:
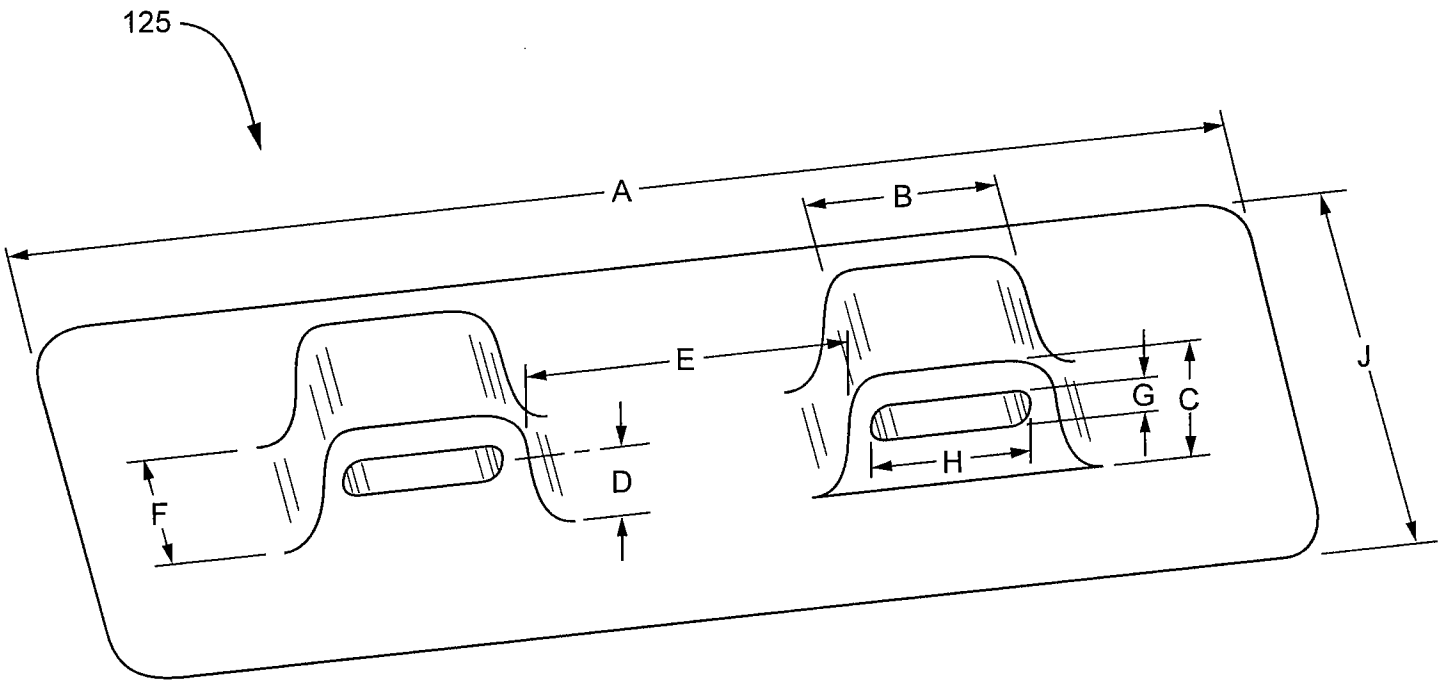
FIG. 18 illustrates a perspective view of a snow/ice attachment 125 in accordance with an exemplary embodiment of the present invention.

In FIG. 17 and FIG. 18, the snow/ice attachment 123 and 125 are illustrated, respectively. A is the length of the snow/ice attachment 123 and 125 (illustrated as 7 inches and 10 inches, but A can be any length). B is the width of the snow/ice attachment 123 and 125 (illustrated as 2 5/16 inches and 2 5/8 inches, but B can be any width). C is the width of each of the one or more connectors 134 of the snow/ice attachment 123 and 125 (illustrated as 1 1/16 inches, but C can be any width). D is the distance between the one or more connectors 134 of the snow/ice attachment 123 and 125 (illustrated as 2 1/2 inches, but D can be any distance). E is the height of the one or more holes 135 of the snow/ice attachment 123 and 125 (illustrated as 9/16 inch, but E can be any height). F is the height of the one or more connectors 134 of the snow/ice attachment 123 and 125 (illustrated as 1 inch, but F can be any height). G is the width of the one or more holes 135 of the snow/ice attachment 123 and 125 (illustrated as 1 inch, but G can be any width). H is the length of each of the one or more connectors 134 of the snow/ice attachment 123 and 125 (illustrated as 1 1/2 inches, but H can be any length). I is the height from above the one or more holes 135 to the connector 134 (illustrated as 1/4 inch, but I can be any height). J is the width of an indentation 123*c* of snow/ice attachment 123 (illustrated as 3/8 inch).

Figure 19:
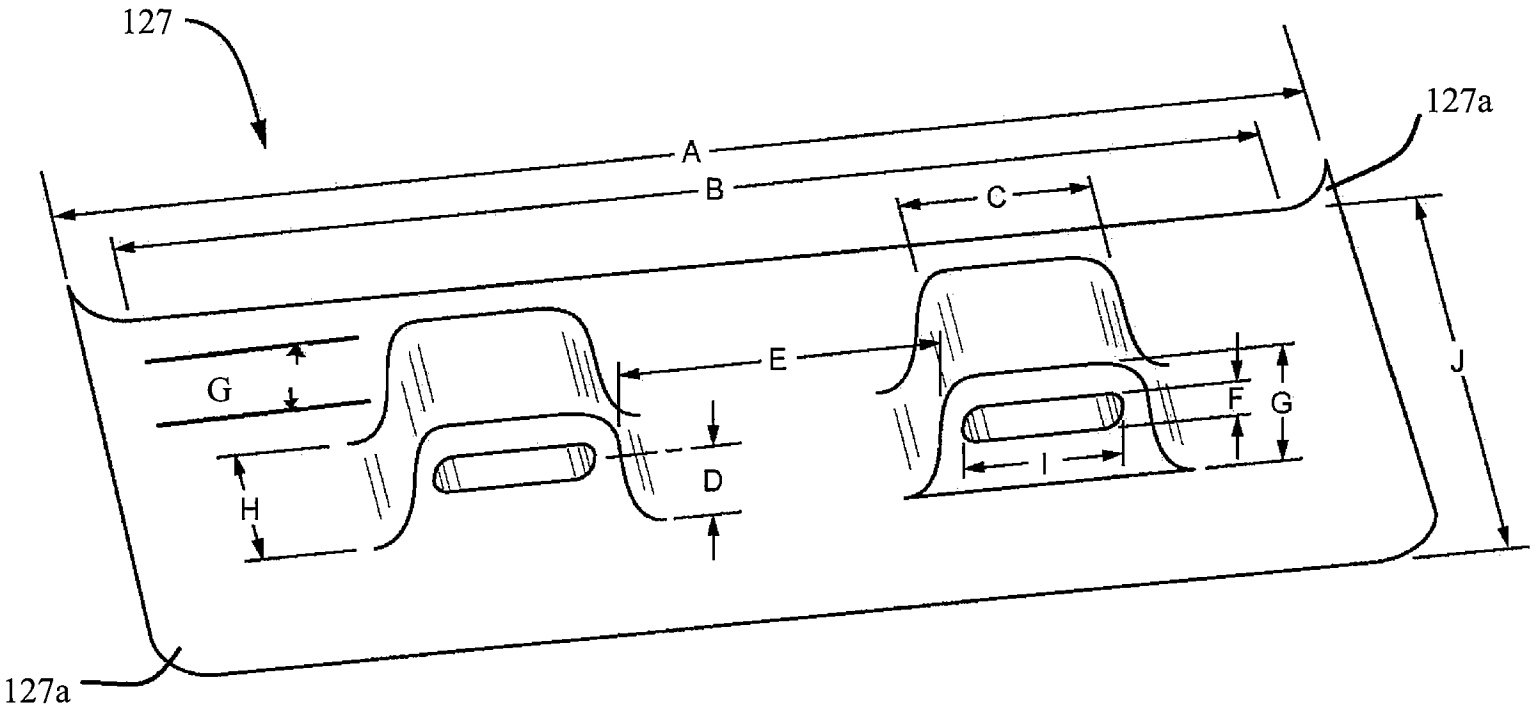
FIG. 19 illustrates a perspective view of a snow/ice attachment 127 in accordance with an exemplary embodiment of the present invention.

In FIG. 19, the snow/ice attachment 127 is illustrated. A is the length of the snow/ice attachment 127 (illustrated as 14 inches, but A can be any length). B is the length of the snow/ice attachment 127 minus the length of the lip 127*a* (illustrated as 11 5/8 inches, but B can be any width). J is the width of the snow/ice attachment 127 (illustrated as 2 5/8 inches). C is the width of each of the one or more connectors 134 of the snow/ice attachment 127 (illustrated as 1 1/16 inches, but C can be any width). D is the distance between the one or more connectors 134 of the snow/ice attachment 127 (illustrated as 2 1/2 inches, but D can be any distance). E is the height of the one or more holes 135 of the snow/ice attachment 127 (illustrated as 9/16 inch, but E can be any height). F is the height of the one or more connectors 134 of the snow/ice attachment 127 (illustrated as 1 inch, but F can be any height). G is the width of the one or more holes 135 of the snow/ice attachment 127 (illustrated as 1 inch, but G can be any width). H is the length of each of the one or more connectors 134 of the snow/ice attachment 127 (illustrated as 1 1/2 inches, but H can be any length). I is the height from above the one or more holes 135 to the connector 134 (illustrated as 1/4 inch, but I can be any height).

In some embodiments, one size wheel can be used for the front wheel 119 (16 inches in diameter) and/or a different size wheel can be used for the back wheel 121 (12 inches in diameter). In other embodiments, the front wheel 119 and the back wheel 121 can be the same size.

While various sizes of the front wheel 119 and/or the back wheel 121 are illustrated or described, any size wheel can be used to accommodate varying sizes of coupler devices 111, 113, 115, and 117. Various sizes and shapes of the first, second, third, and fourth coupler devices 111, 113, 115, 117 are also illustrated or described; however, any size and shape frame can be used to accommodate varying sizes of the front wheel 119 and/or the back wheel 121.

The various wheels, brake, and stopper of in-line skate 100 can be made of at least one of wood, plastic, metal, polyurethane, rubber, copolymer plastic, nylon, urethane plastic, any light weight material, and steel. The various frames and coupler devices can be made of at least one of aluminum, plastic over aluminum, aluminum over plastic, carbon fiber, titanium, wood, plastic, metal, polyurethane, rubber, copolymer plastic, nylon, urethane plastic, and steel. The thickness of the various frames and coupler devices can vary from about ⅛ inch to about 1 inch. The bearings, axles (or axle bolts), and axle nuts can be made of at least one of aluminum, carbon fiber, titanium, ceramic materials, wood, plastic, metal, polyurethane, rubber, copolymer plastic, nylon, urethane plastic, and steel.

In the foregoing specification, the invention has been described with reference to specific embodiments. However, it will be appreciated that various modifications and changes can be made without departing from the scope of the present invention as set forth in the claims below. The specification and figures are to be regarded in an illustrative manner, rather than a restrictive one, and all such modifications are intended to be included within the scope of present invention. Accordingly, the scope of the invention should be determined by the appended claims and their legal equivalents, rather than by the examples given above. For example, the steps recited in any of the method or process claims may be executed in any order and are not limited to the order presented in the claims.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as critical, required, or essential features or elements of any or all the claims. As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus. Further, no element described herein is required for the practice of the invention unless expressly described as "essential" or "critical".

The invention claimed is:

1. A device for coupling to an in-line skate device, the in-line skate device comprising a boot configured to couple to a frame wherein the frame is configured to couple to at least a first wheel and a second wheel and the frame is linear in shape and traverses at least a portion of the bottom of the boot, the device for coupling to the in-line skate device comprising:

a first coupler device configured to couple to the frame, wherein the first coupler device includes a linear portion and an angled portion, wherein the linear portion and the angled portion have different lengths, wherein the linear portion includes a first hole configured to couple to the frame below the bottom of the boot, wherein the first hole is located near the end of the linear portion that is opposite the angled portion, wherein the linear portion includes a second hole located at an area where the linear portion meets the angled portion, wherein the angled portion has an angle greater than zero, wherein the angled portion includes a third hole near the end of the angled portion that is opposite the linear portion, and wherein the third hole is positioned above the bottom of the boot when the first coupler device is coupled to the frame.

2. The device of claim 1, wherein the second hole is configured to couple to the frame and the third hole of the angled portion is configured to couple to a third wheel of the in-line skate device.

3. The device of claim 1, wherein the linear portion of the first coupler device varies in length from 1 inch to 25 inches, the angled portion of the first coupler device varies in length from 1 inch to 25 inches, and the angled portion of the first coupler device varies in range from 1 degree to 90 degrees.

4. The device of claim 1, wherein at least one of:

the first coupler device is coupled to a front portion of the frame and a second coupler device is coupled to the front portion of the frame such that the first and second coupler devices sandwich the frame at the front portion; and a third coupler device is coupled to a back portion of the frame and a fourth coupler device is coupled to the back portion of the frame such that the third and fourth coupler devices sandwich the frame at the back portion.

5. The device of claim 4, wherein at least one of:

the linear portion of the first coupler device is coupled to the frame on the front portion of the frame and the angled portion of the first coupler device is coupled to a third wheel on the front portion of the frame; and the linear portion of the second coupler device is coupled to the frame on the front portion of the frame and the angled portion of the second coupler device is coupled to the third wheel on the front portion of the frame.

6. The device of claim 4, wherein at least one of:

the linear portion of the third coupler device is coupled to the frame on the back portion of the frame and the angled portion of the third coupler device is coupled to a fourth wheel on the back portion of the frame; and the linear portion of the fourth coupler device is coupled to the frame on the back portion of the frame and the angled portion of the fourth coupler device is coupled to the fourth wheel on the back portion of the frame.

7. The device of claim 1, wherein a second coupler device is coupled to the front portion of the frame and the first and second coupler devices are coupled to a third wheel, such that the first and second coupler devices sandwich the frame and the third wheel.

8. The device of claim 1, wherein the first coupler device is configured to be coupled to the frame at a position along the length of the linear portion that is adjustable.

9. The device of claim 1, wherein the first coupler device has an angled piece in the angled portion and the angled piece is angled out in the z direction.

10. An in-line skate device comprising:

a boot coupled to a frame, wherein the frame is coupled to at least a first wheel and a second wheel, and wherein the frame is linear in shape and traverses at least a portion of the bottom of the boot, and a first coupler device coupled to the frame, wherein the first coupler device includes a linear portion and an angled portion, wherein the linear portion is coupled to the frame below the bottom of the boot, wherein the angled portion has an angle greater than zero; and wherein the frame supports an axle of at least one of the first wheel and the second wheel above the bottom of the boot.

11. The device of claim 10, wherein the angled portion of the first coupler device varies in range from 1 degree to 90 degrees, the linear portion of the first coupler device varies in length from 1 inch to 25 inches, and the angled portion of the first coupler device varies in length from 1 inch to 25 inches.

12. The device of claim 11, wherein a third wheel is coupled to the angled portion of the first coupler, the third wheel has a diameter that varies in range from 1 inch to 25 inches, and wherein the third wheel comprises one or more of the following a bicycle wheel, automobile tire, wood, plastic, metal, polyurethane, rubber, copolymer plastic, nylon, urethane plastic, and steel.

13. The device of claim 10, wherein the linear portion and the angled portion of the first coupler device have different lengths, wherein the linear portion includes a first hole located near the end of the linear portion that is opposite the angled portion, wherein the angled portion includes a second hole located at an area where the linear portion meets the angled portion, wherein the angled portion has an angle greater than zero, wherein the angled portion includes a third hole near the end of the angled portion that is opposite the linear portion.

14. The device of claim 10, wherein at least one of:

the first coupler device is coupled to a front portion of the frame and a second coupler device is coupled to the front portion of the frame such that the first and second coupler devices sandwich the frame at the front portion; and a third coupler device is coupled to a back portion of the frame and a fourth coupler device is coupled to the back portion of the frame such that the third and fourth coupler devices sandwich the frame at the back portion.

15. The device of claim 14, wherein at least one of:

the linear portion of the first coupler device is coupled to the frame on the front portion of the frame and the angled portion of the first coupler device is coupled to a third wheel on the front portion of the frame; and the linear portion of the second coupler device is coupled to the frame on the front portion of the frame and the angled portion of the second coupler device is coupled to the third wheel on the front portion of the frame.

16. The device of claim 14, wherein at least one of:

the linear portion of the third coupler device is coupled to the frame on the back portion of the frame and the angled portion of the third coupler device is coupled to a fourth wheel on the back portion of the frame; and the linear portion of the fourth coupler device is coupled to the frame on the back portion of the frame and the angled portion of the fourth coupler device is coupled to the fourth wheel on the back portion of the frame.

17. The device of claim 10, wherein a second coupler device is coupled to the front portion of the frame and the first coupler device and the second coupler device are both coupled to a third wheel, such that the first coupler device and the second coupler device sandwich the frame and the third wheel.

18. The device of claim 10, wherein at least one of:

a snow/ice attachment is coupled to the frame, wherein the snow/ice attachment includes a flat surface, one or more connectors, and a hole through the one or more connectors, and wherein the one or more connectors are coupled to the frame via the hole through the one or more connectors, one or more spacers are coupled between the frame and the first coupler device via one or more holes on the first coupler device, the one or more holes on the first coupler device are elongated in the x direction or the y direction.

19. A device for coupling to an in-line skate device, comprising:

a first coupler device including a linear portion and an angled portion wherein the linear portion and the angled portion have different lengths, wherein the linear portion includes a first hole located near the end of the linear portion that is opposite the angled portion, wherein the angled portion includes a second hole located at an area where the linear portion meets the angled portion, wherein the angled portion has an angle greater than zero, wherein the angled portion includes a third hole near the end of the angled portion that is opposite the linear portion; and wherein the first coupler device is configured so that the third hole is positioned above the bottom of a boot when the first coupler device is coupled to a frame of the boot.

20. The device of claim 10, wherein a third wheel is coupled to the angled portion of the first coupler device and wherein the wheel comprises an airless wheel.

* * * * *